US010314405B2

(12) United States Patent
Grey

(10) Patent No.: US 10,314,405 B2
(45) Date of Patent: Jun. 11, 2019

(54) FLOATING BEDS

(71) Applicant: Dyan Grey, New York, NY (US)

(72) Inventor: Dyan Grey, New York, NY (US)

( * ) Notice: Subject to any disclaimer, the term of this patent is extended or adjusted under 35 U.S.C. 154(b) by 227 days.

(21) Appl. No.: 15/277,336

(22) Filed: Sep. 27, 2016

(65) Prior Publication Data

US 2017/0013967 A1 Jan. 19, 2017

Related U.S. Application Data

(60) Continuation of application No. 15/217,009, filed on Jul. 22, 2016, which is a division of application No. 14/986,441, filed on Dec. 31, 2015, now Pat. No. 9,414,689.

(60) Provisional application No. 62/169,304, filed on Jun. 1, 2015.

(51) Int. Cl.

| | |
|---|---|
| ***A47C 17/46*** | (2006.01) |
| ***A47C 19/02*** | (2006.01) |
| ***A47C 17/38*** | (2006.01) |

(52) U.S. Cl.

CPC ..... *A47C 17/46* (2013.01); *A47C 17/38* (2013.01); *A47C 19/021* (2013.01); *A47C 19/022* (2013.01); *A47C 19/025* (2013.01)

(58) Field of Classification Search

CPC ..... A47C 19/00; A47C 19/005; A47C 19/02; A47C 19/021; A47C 19/22; A47C 19/025; A47C 19/027; A47C 19/04; A47C 17/38; A47C 17/40; A47C 17/42; A47C 17/44; A47C 17/46; A47C 17/48; A47C 17/50; A47C 17/52; A47C 17/58; A47C 20/027; A47C 19/022

USPC ..... D6/382, 393, 394, 395

See application file for complete search history.

(56) References Cited

U.S. PATENT DOCUMENTS

| | | | | |
|---|---|---|---|---|
| 79,622 | A | 7/1868 | Young | |
| 890,556 | A * | 6/1908 | Chatem | A47C 17/40 5/131 |
| 4,370,766 | A | 2/1983 | Teague, Jr. | |
| 5,459,893 | A | 10/1995 | Walters, III | |
| 5,652,978 | A | 8/1997 | Wiig | |
| 5,715,548 | A | 2/1998 | Weismiller et al. | |
| 5,802,640 | A | 9/1998 | Ferrand et al. | |

(Continued)

OTHER PUBLICATIONS

"Letti Beds." https://issuu.com/presottoitaliadesign/docs/notte_letti_beds_2014. N.p., 2014. Web. May 11, 2016.

(Continued)

*Primary Examiner* — Nicholas F Polito
*Assistant Examiner* — Amanda L Bailey
(74) *Attorney, Agent, or Firm* — Dentons US LLP

(57) ABSTRACT

A device comprising: a bed frame comprising a platform frame and a headboard frame, wherein the platform frame is T-shaped as defined via a leg portion and a platform portion, wherein the platform portion comprises a spine portion extending longitudinally over the leg portion, wherein the headboard frame defines a U-shaped channel, wherein the spine portion extends through the U-shaped channel and the headboard frame is non-perpendicularly oriented to the platform portion when the headboard frame spans between a wall and a floor, the platform portion is secured to the wall cantileveredly, and the headboard frame is secured to the wall distal to the floor.

20 Claims, 13 Drawing Sheets

(56) References Cited

U.S. PATENT DOCUMENTS

| | | | |
|---|---|---|---|
| 5,906,016 | A | 5/1999 | Ferrand et al. |
| 5,906,017 | A | 5/1999 | Ferrand et al. |
| 6,163,903 | A | 12/2000 | Weismiller et al. |
| 6,352,240 | B1 | 3/2002 | Eckstein et al. |
| 6,438,776 | B2 | 8/2002 | Ferrand et al. |
| 7,017,208 | B2 | 3/2006 | Weismiller et al. |
| 7,107,636 | B2 | 9/2006 | Metz et al. |
| 7,213,279 | B2 | 5/2007 | Weismiller et al. |
| 7,231,675 | B1 | 6/2007 | Rucinski et al. |
| 7,237,287 | B2 | 7/2007 | Weismiller et al. |
| 7,253,366 | B2 | 8/2007 | Bhai |
| 7,296,312 | B2 | 11/2007 | Menkedick et al. |
| 7,406,731 | B2 | 8/2008 | Menkedick et al. |
| 7,437,787 | B2 | 10/2008 | Bhai |
| 7,480,951 | B2 | 1/2009 | Weismiller et al. |
| 7,506,390 | B2 | 3/2009 | Dixon et al. |
| 7,520,006 | B2 | 4/2009 | Menkedick et al. |
| 7,533,429 | B2 | 5/2009 | Menkedick et al. |
| 7,568,246 | B2 | 8/2009 | Weismiller et al. |
| 7,610,637 | B2 | 11/2009 | Menkedick et al. |
| 7,669,263 | B2 | 3/2010 | Menkedick et al. |
| 7,676,862 | B2 | 3/2010 | Poulos et al. |
| 7,703,158 | B2 | 4/2010 | Wilker, Jr. et al. |
| 7,743,441 | B2 | 6/2010 | Poulos et al. |
| 7,757,318 | B2 | 7/2010 | Poulos et al. |
| 7,779,494 | B2 | 8/2010 | Poulos et al. |
| 7,784,128 | B2 | 8/2010 | Kramer |
| 7,926,131 | B2 | 4/2011 | Menkedick et al. |
| 8,056,160 | B2 | 11/2011 | Poulos et al. |
| 8,065,764 | B2 | 11/2011 | Kramer |
| 8,069,514 | B2 | 12/2011 | Poulos et al. |
| RE43,532 | E | 7/2012 | Menkedick et al. |
| 8,341,778 | B2 | 1/2013 | Heimbrock |
| 8,413,274 | B2 | 4/2013 | Weismiller et al. |
| 8,516,637 | B2 | 8/2013 | Karwal et al. |
| 8,864,205 | B2 | 10/2014 | Lemire et al. |
| 8,869,324 | B1 | 10/2014 | Lin |
| 9,009,893 | B2 | 4/2015 | Kramer et al. |
| 9,119,753 | B2 | 9/2015 | Poulos et al. |
| 2001/0029628 | A1 | 10/2001 | Ferrand et al. |
| 2002/0059679 | A1 | 5/2002 | Weismiller |
| 2002/0130286 | A1 | 9/2002 | Eckstein et al. |
| 2003/0056289 | A1 | 3/2003 | Nockles |
| 2005/0172405 | A1 | 8/2005 | Menkedick |
| 2006/0150332 | A1 | 7/2006 | Weismiller et al. |
| 2006/0162079 | A1 | 7/2006 | Menkedick et al. |
| 2006/0168729 | A1 | 8/2006 | Weismiller et al. |
| 2006/0168730 | A1 | 8/2006 | Menkedick et al. |
| 2006/0168731 | A1 | 8/2006 | Menkedick et al. |
| 2007/0180618 | A1 | 8/2007 | Weismiller et al. |
| 2008/0010748 | A1 | 1/2008 | Menkedick et al. |
| 2008/0052831 | A1 | 3/2008 | Weismiller et al. |
| 2008/0201847 | A1 | 8/2008 | Menkedick et al. |
| 2008/0201851 | A1 | 8/2008 | Menkedick et al. |
| 2008/0289108 | A1 | 11/2008 | Menkedick et al. |
| 2009/0151073 | A1 | 6/2009 | Kramer |
| 2009/0313758 | A1 | 12/2009 | Menkedick et al. |
| 2010/0306921 | A1 | 12/2010 | Kramer |
| 2012/0102647 | A1 | 5/2012 | Weismiller et al. |
| 2012/0174319 | A1 | 7/2012 | Menkedick et al. |
| 2012/0256467 | A1* | 10/2012 | Pettingill ..... A47C 23/06 297/452.55 |
| 2015/0224005 | A1 | 8/2015 | Kramer et al. |

OTHER PUBLICATIONS

"Plana Designer Floating Bed by Presotto #18461" https://web.archive.org/web/20120626084938/http://www.eroomservice.com/furniture/plana-designer-floating-bed.html. N. p., Apr. 11, 2012. Web May 11, 2016.

"Letti Beds_257." https://issuu.com/presottoitaliadesign/docs/notte_letti_beds_2014. N.p., 2014. Web. May 11, 2016.

* cited by examiner

FLOATING BEDS

CROSS-REFERENCE TO RELATED APPLICATIONS

This application is a Continuation of Ser. No. 15/217,009 filed 22 Jul. 2016; which is a Divisional of Ser. No. 14/986,441 filed 31 Dec. 2015, now U.S. Pat. No. 9,414,689 issued 16 Aug. 2016; which claims a benefit of U.S. Provisional Patent Application 62/169,304 filed 1 Jun. 2015; all of which are herein fully incorporated by reference for all purposes.

TECHNICAL FIELD

The present disclosure relates to beds.

BACKGROUND

In the present disclosure, where a document, an act and/or an item of knowledge is referred to and/or discussed, then such reference and/or discussion is not an admission that the document, the act and/or the item of knowledge and/or any combination thereof was at the priority date, publicly available, known to the public, part of common general knowledge and/or otherwise constitutes prior art under the applicable statutory provisions; and/or is known to be relevant to an attempt to solve any problem with which the present disclosure is concerned with. Further, nothing is disclaimed.

A bed is a piece of furniture, which is used for sleeping or relaxation. Often, the bed is structured in a way that creates an unsightly appearance. Resultantly, the bed is decorated with an aesthetic bedding to make up for such appearance. However, such decoration can be costly to purchase, time-consuming to maintain, or inappropriate with ambient decor. Moreover, the bed can also be structured in a way to define a storage space underneath. However, such space can be limited in volume/shape or hard to access due to the bed's structure.

BRIEF SUMMARY

The present disclosure at least partially addresses at least one of the above. However, the present disclosure can prove useful to other technical areas. Therefore, the claims should not be construed as necessarily limited to addressing any of the above.

In an embodiment a device comprises: a bed frame comprising a platform frame and a headboard frame, wherein the platform frame is T-shaped as defined via a leg portion and a platform portion, wherein the platform portion comprises a spine portion extending longitudinally over the leg portion, wherein the headboard frame defines a U-shaped channel, wherein the spine portion extends through the U-shaped channel and the headboard frame is non-perpendicularly oriented to the platform portion when the headboard frame spans between a wall and a floor, the platform portion is secured to the wall cantileveredly, and the headboard frame is secured to the wall distal to the floor.

In an embodiment, a device comprises: a bed frame comprising: a pair of rails secured to a wall cantileveredly; a headboard spanning between the wall and a floor, wherein the headboard is non-perpendicular to the floor, wherein the headboard extends between the rails laterally; a spine portion extending from the headboard away from the wall, wherein the spine portion contacts the floor; a U-shaped frame defined via a base portion and a pair of side portions, wherein the side portions travel via the rails, wherein the base portion opposes the headboard; a platform portion supported via the side portions, wherein the platform portion travels via the side portions.

The present disclosure may be embodied in the form illustrated in the accompanying drawings. However, attention is called to the fact that the drawings are illustrative. Variations are contemplated as being part of the disclosure, limited only by the scope of the claims.

BRIEF DESCRIPTION OF DRAWINGS

The accompanying drawings illustrate embodiments of the present disclosure. Such drawings are not to be construed as necessarily limiting the disclosure. Like numbers and/or similar numbering scheme can refer to like and/or similar elements throughout.

DETAILED DESCRIPTION OF PREFERRED EMBODIMENTS

Figure 1:
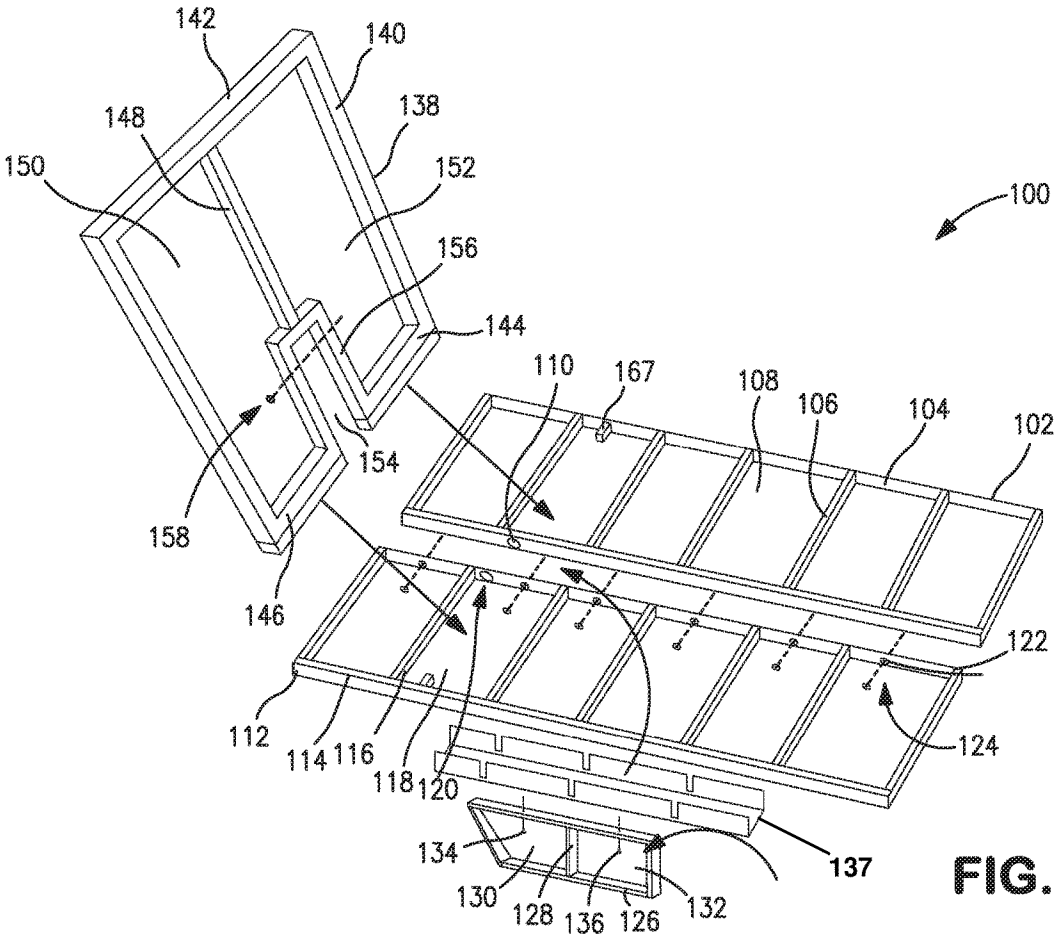
FIG. 1 shows an exploded view of a bed frame, according to an embodiment of the present disclosure.

The present disclosure is now described more fully with reference to the accompanying drawings, in which embodiments of the present disclosure are shown. The present disclosure may, however, be embodied in many different forms and should not be construed as necessarily being limited to the embodiments disclosed herein. Rather, these embodiments are provided so that the present disclosure is thorough and complete, and fully conveys the concepts of the present disclosure to those skilled in the relevant art.

Features described with respect to certain embodiments may be combined and sub-combined in and/or with various other embodiments. Also, different aspects and/or elements of embodiments, as disclosed herein, may be combined and sub-combined in a similar manner as well. Further, some embodiments, whether individually and/or collectively, may be components of a larger system, wherein other procedures may take precedence over and/or otherwise modify their application. Additionally, a number of steps may be required before, after, and/or concurrently with embodiments, as disclosed herein. Note that any and/or all methods and/or processes, at least as disclosed herein, can be at least partially performed via at least one entity in any manner.

The terminology used herein can imply direct or indirect, full or partial, temporary or permanent, action or inaction. For example, when an element is referred to as being "on," "connected" or "coupled" to another element, then the element can be directly on, connected or coupled to the other element and/or intervening elements can be present, including indirect and/or direct variants. In contrast, when an element is referred to as being "directly connected" or "directly coupled" to another element, there are no intervening elements present.

Although the terms first, second, etc. can be used herein to describe various elements, components, regions, layers and/or sections, these elements, components, regions, layers and/or sections should not necessarily be limited by such terms. These terms are used to distinguish one element, component, region, layer or section from another element, component, region, layer or section. Thus, a first element, component, region, layer, or section discussed below could be termed a second element, component, region, layer, or section without departing from the teachings of the present disclosure.

The terminology used herein is for describing particular embodiments and is not intended to be necessarily limiting of the present disclosure. As used herein, the singular forms "a," "an" and "the" are intended to include the plural forms as well, unless the context clearly indicates otherwise. The terms "comprises," "includes" and/or "comprising," "including" when used in this specification, specify the presence of stated features, integers, steps, operations, elements, and/or components, but do not preclude the presence and/or addition of one or more other features, integers, steps, operations, elements, components, and/or groups thereof.

As used herein, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances.

Embodiments of the present disclosure are described herein with reference to illustrations of idealized embodiments (and intermediate structures) of the present disclosure. As such, variations from the shapes of the illustrations as a result, for example, of manufacturing techniques and/or tolerances, are to be expected. Thus, the embodiments of the present disclosure should not be construed as necessarily limited to the particular shapes of regions illustrated herein, but are to include deviations in shapes that result, for example, from manufacturing.

Any and/or all elements, as disclosed herein, can be formed from a same, structurally continuous piece, such as being unitary, and/or be separately manufactured and/or connected, such as being an assembly and/or modules. Any and/or all elements, as disclosed herein, can be manufactured via any manufacturing processes, whether additive manufacturing, subtractive manufacturing, and/or other any other types of manufacturing. For example, some manufacturing processes include three dimensional (30) printing, laser cutting, computer numerical control routing, milling, pressing, stamping, vacuum forming, hydroforming, injection molding, lithography, and so forth.

Any and/or all elements, as disclosed herein, can be and/or include, whether partially and/or fully, a solid, including a metal, a mineral, a gemstone, an amorphous material, a ceramic, a glass ceramic, an organic solid, such as wood and/or a polymer, such as rubber, a composite material, a semiconductor, a nanomaterial, a biomaterial and/or any combinations thereof. Any and/or all elements, as disclosed herein, can be and/or include, whether partially and/or fully, a coating, including an informational coating, such as ink, an adhesive coating, a melt-adhesive coating, such as vacuum seal and/or heat seal, a release coating, such as tape liner, a low surface energy coating, an optical coating, such as for tint, color, hue, saturation, tone, shade, transparency, translucency, opaqueness, luminescence, reflection, phosphorescence, anti-reflection and/or holography, a photo-sensitive coating, an electronic and/or thermal property coating, such as for passivity, insulation, resistance or conduction, a magnetic coating, a water-resistant and/or waterproof coating, a scent coating and/or any combinations thereof. Any and/or all elements, as disclosed herein, can be rigid, flexible, and/or any other combinations thereof. Any and/or all elements, as disclosed herein, can be identical and/or different from each other in material, shape, size, color and/or any measurable dimension, such as length, width, height, depth, area, orientation, perimeter, volume, breadth, density, temperature, resistance, and so forth.

Unless otherwise defined, all terms (including technical and scientific terms) used herein have the same meaning as commonly understood by one of ordinary skill in the art to which this disclosure belongs. The terms, such as those defined in commonly used dictionaries, should be interpreted as having a meaning that is consistent with their meaning in the context of the relevant art and should not be interpreted in an idealized and/or overly formal sense unless expressly so defined herein.

Furthermore, relative terms such as "below," "lower," "above," and "upper" can be used herein to describe one element's relationship to another element as illustrated in the accompanying drawings. Such relative terms are intended to encompass different orientations of illustrated technologies in addition to the orientation depicted in the accompanying drawings. For example, if a device in the accompanying drawings were turned over, then the elements described as being on the "lower" side of other elements would then be oriented on "upper" sides of the other elements. Similarly, if the device in one of the figures were turned over, elements described as "below" or "beneath" other elements would then be oriented "above" the other elements. Therefore, the example terms "below" and "lower" can encompass both an orientation of above and below.

As used herein, the term "about" and/or "substantially" refers to a +/−10% variation from the nominal value/term. Such variation is always included in any given value/term provided herein, whether or not such variation is specifically referred thereto.

If any disclosures are incorporated herein by reference and such disclosures conflict in part and/or in whole with the present disclosure, then to the extent of conflict, and/or broader disclosure, and/or broader definition of terms, the present disclosure controls. If such disclosures conflict in part and/or in whole with one another, then to the extent of conflict, the later-dated disclosure controls.

FIG. 1 shows an exploded view of a bed frame, according to an embodiment of the present disclosure. A bed frame 100 includes a first frame section 102. The first frame section 102 is defined via a plurality of longitudinal elements 104, such as beams, shafts, or bars of any cross section, whether solid or hollow internally, and a plurality of lateral elements 106, such as beams, shafts, or bars of any cross section, whether solid or hollow internally. The longitudinal elements 104 extend in parallel to each other. The lateral elements 106 extend in parallel with each other. The lateral elements 106 span between the longitudinal elements 104. Accordingly, the longitudinal elements 104 and the lateral elements 106 define a plurality of open spaces 108 via such configuration. The first frame section 102 can be one-piece, such as unitary, or an assembly of pieces.

The longitudinal elements 104 are parallel to each other. However, the longitudinal elements 104 can be non-parallel to each other, such as acutely or obtusely angled. The lateral elements 106 are parallel to each other. However, the lateral elements 106 can be non-parallel to each other, such as acutely or obtusely angled. The lateral elements 106 are perpendicular to the longitudinal elements 104. However, the lateral elements 106 can be non-perpendicular to the longitudinal elements 104, such as obtusely or acutely angled. The longitudinal elements 104 are one-piece, such as unitary, but can be an assembly. The lateral elements 106 are one-piece, such as unitary, but can be an assembly. The longitudinal elements 104 are one-piece, such as unitary, to the lateral elements 106, but can be an assembly. At least one of the longitudinal elements 104 extends rectilinearly, but can extend in other manners, such as sinusoidal, arcuate, pulse-shaped, zigzag, or any other manner. At least one of the lateral elements 106 extends rectilinearly, but can extend in other manners, such as sinusoidal, arcuate, pulse-shaped, zigzag, or any other manner.

Although the open spaces 108 are rectangular in shape, the open spaces 108 can be shaped differently depending on how the longitudinal elements 104 or the lateral elements 106 are configured. For example, the open spaces 108 can be square, oval, arcuate, or rhombus shaped. Note that other longitudinal elements 104 can span between the lateral elements 106, whether in parallel to at least one of the longitudinal elements 104 or not. For example, if a longitudinal element 104 spans between two of the lateral elements 106, while being parallel to at least one of the longitudinal elements 104, an H-shape can be formed. However, if a longitudinal element 104 spans between two of the lateral elements 106, while not being parallel to at least one of the longitudinal elements 104, a Z-shape can be formed. Alternatively, the first frame section 102 includes only one longitudinal element 104, such as an inner longitudinal element 104, such that the lateral elements 106 extend from the only one longitudinal element 104 in a cantilevered manner, whether perpendicular or non-perpendicular thereto, such as obtusely or acutely angled. For example, such configuration be in an E-shape manner, a rib manner, or a herringbone manner, such as a V-manner. Alternatively, the first frame section 102 lacks the open spaces 108 and is therefore solid, such as via being planar.

Further, note that at least one of the longitudinal elements 104 contains at least one of metal, wood, plastic, rubber, glass, stone, or another suitable material. Likewise, note that at least one of the lateral elements 106 contains at least one of metal, wood, plastic, rubber, glass, stone, or another suitable material.

Additionally, an inner longitudinal element 104 of the longitudinal elements 104 defines a bore 110. The bore 110 is circular in shape and threaded, but can be at least one of non-circular or non-threaded. The bore 110 extends fully through the inner longitudinal element 104 of the longitudinal elements 104. Alternatively, the bore 110 does not extend fully through the inner longitudinal element 104 of the longitudinal elements 104 such that the bore 110 is stopped, such as a well.

The bed frame 100 also includes a second frame section 112. The first frame section 102 and the second frame section 112 can be configured identical to or different from each other in any manner, whether in whole or in part, whether in structure, shape, function, material, size, component, weight, or any other aspect. The second frame section 112 is defined via a plurality of longitudinal elements 114, such as beams, shafts, or bars of any cross section, whether solid or hollow internally, and a plurality of lateral elements 116, such as beams, shafts, or bars of any cross section, whether solid or hollow internally. The longitudinal elements 114 extend in parallel to each other. The lateral elements 116 extend in parallel with each other. The lateral elements 116 span between the longitudinal elements 114. Accordingly, the longitudinal elements 114 and the lateral elements 116 define a plurality of open spaces 118 via such configuration. The second frame section 112 can be one-piece, such as unitary, or an assembly of pieces.

The longitudinal elements 114 are parallel to each other. However, the longitudinal elements 114 can be non-parallel to each other, such as acutely or obtusely angled. The lateral elements 116 are parallel to each other. However, the lateral elements 116 can be non-parallel to each other, such as acutely or obtusely angled. The lateral elements 116 are perpendicular to the longitudinal elements 114. However, the lateral elements 116 can be non-perpendicular to the longitudinal elements 114, such as obtusely or acutely angled. The longitudinal elements 114 are one-piece, such as unitary, but can be an assembly. The lateral elements 116 are one-piece, such as unitary, but can be an assembly. The longitudinal elements 114 are one-piece, such as unitary, to the lateral elements 116, but can be an assembly. At least one of the longitudinal elements 114 extends rectilinearly, but can extend in other manners, such as sinusoidal, arcuate, pulse-shaped, zigzag, or any other manner. At least one of the lateral elements 116 extends rectilinearly, but can extend in other manners, such as sinusoidal, arcuate, pulse-shaped, zigzag, or any other manner.

Although the open spaces 118 are rectangular in shape, the open spaces 118 can be shaped differently depending on how the longitudinal elements 114 or the lateral elements 116 are configured. For example, the open spaces 118 can be square, oval, arcuate, or rhombus shaped. Note that other longitudinal elements 114 can span between the lateral elements 116, whether in parallel to at least one of the longitudinal elements 114 or not. For example, if a longitudinal element 114 spans between two of the lateral elements 116, while being parallel to at least one of the longitudinal elements 114, an H-shape can be formed. However, if a longitudinal element 114 spans between two of the lateral elements 116, while not being parallel to at least one of the longitudinal elements 114, a Z-shape can be formed. Alternatively, the first frame section 112 includes only one longitudinal element 114, such as an inner longitudinal element 114, such that the lateral elements 116 extend from the only one longitudinal element 114 in a cantilevered manner, whether perpendicular or non-perpendicular thereto, such as obtusely or acutely angled. For example, such configuration be in an E-shape manner, a rib manner, or a herringbone manner, such as a V-manner. Alternatively, the second frame section 112 lacks the open spaces 118 and is therefore solid, such as via being planar.

Further, note that at least one of the longitudinal elements 114 contains at least one of metal, wood, plastic, rubber, glass, stone, or another suitable material. Likewise, note that at least one of the lateral elements 116 contains at least one of metal, wood, plastic, rubber, glass, stone, or another suitable material.

Additionally, an inner longitudinal element 114 of the longitudinal elements 114 defines a bore 120. The bore 120 is circular in shape and threaded, but can be at least one of non-circular or non-threaded. The bore 120 extends fully through the inner longitudinal element 114 of the longitudinal elements 114. Alternatively, the bore 120 does not extend fully through the inner longitudinal element 114 of the longitudinal elements 114 such that the bore 120 is stopped, such as a well. The bore 110 and the bore 120 are aligned with each other, such as via opposing each other, while extending parallel to the lateral elements 106 and 116. However, note that such alignment can also be offset, such as via extending non-parallel to the lateral elements 106 and 116.

Although the first frame section 102 and the second frame section 112 can be one-piece, such as unitary via molding, additive manufacturing, subtractive manufacturing, or any other suitable manner, the first frame section 102 and the second frame section 112 can also be assembled with each other, such as via the inner longitudinal element 104 and the inner longitudinal element 114 coupling to each other. Such assembly can be via any manner of coupling, such as fastening, mating, interlocking, adhering, clamping, bracketing, tying, or any other suitable manner.

The first frame section 102 and the second frame section 112 define a platform frame along a horizontal plane when the inner longitudinal element 104 and the inner longitudinal element 114 are adjacent, such as immediately, to each other and when the bore 110 and the bore 120 align, whether along a horizontal or a diagonal plane. Based on such positioning, a platform frame spine is formed via the inner longitudinal element 104 and the inner longitudinal element 114. Alternatively, the inner longitudinal element 104 and the inner longitudinal element 114 can be one element, which is then the platform frame spine.

As shown in FIG. 1, the inner longitudinal element 104 and the inner longitudinal element 114 are coupled to each other via fastening with a set of fasteners 124 through a set of bores 122, whether perpendicular or non-perpendicular to at least one of the inner longitudinal element 104 or the inner longitudinal element 114. Each of the inner longitudinal element 104 and the inner longitudinal element 114 contains the set of bores 122. The sets of bores 122 are complementary to each other, such as at least one of the bores 122 in the inner longitudinal element 104 corresponds to at least one of the bores 122 in the inner longitudinal element 114. Such complementation can be via bore alignment, such as via opposing each other, while extending parallel to the lateral elements 106 and 116. However, note that such alignment can also be offset, such as via extending non-parallel to the lateral elements 106 and 116. The set of fasteners 124 comprises a at least one of a screw or a bolt. Note that nuts can be used to thread onto the set of fasteners 124 to further secure the inner longitudinal element 104 and the inner longitudinal element 114. For example, at least one of the nuts can include a torus-shaped nut or a wing nut. Alternatively, a set of pegs or maters can be used to couple the inner longitudinal element 104 to the inner longitudinal element 114.

The bed frame 100 also includes a leg portion 126, which can be solid or hollow internally. The leg portion 126 can be of any cross-section. From a side view, such as a left side view or a right side view, the leg portion 126 is shaped as a trapezoid. However, note that the leg portion 126 can also be shaped differently from a side view, whether in an open shape or a closed shape. For example, the leg portion 126 can be shaped as an arc, a triangle, a square, a rectangle, a star, a pentagon, a hexagon, an octagon, or any other shape or polygon. From at least one of a front view or a back view, the leg portion 126 can be shaped as a square, a trapezoid, an arc, a triangle, a rectangle, a star, a pentagon, a hexagon, an octagon, or any other shape or polygon. The leg portion 126 can contain at least one of metal, wood, plastic, rubber, glass, stone, or another suitable material. The leg portion 126 can be one-piece, such as unitary, or an assembly. The leg portion 126 extends rectilinearly along a longitudinal axis, but can extend in other manners, such as sinusoidal, arcuate, pulse-shaped, zigzag, or any other manner. The leg portion 126 extends rectilinearly along a vertical axis, but can extend in other manners, such as sinusoidal, arcuate, pulse-shaped, zigzag, or any other manner A support or reinforcement column 128 extends within the leg portion 126 to bolster support. The column 128 can be hollow or solid internally. The column 128 can be one-piece, such as unitary, or an assembly. The column 128 can be one-piece, such as unitary, with the leg portion 126 or an assembly with the leg portion 126. The column 128 can contain at least one of metal, wood, plastic, rubber, glass, stone, or another suitable material. The column 128 extends rectilinearly, but can extend in other manners, such as sinusoidal, arcuate, pulse-shaped, zigzag, or any other manner. The column 128 spans between a lower longitudinal portion of the leg portion 126 and an upper longitudinal portion of the leg portion 126. The column 128 is positioned such that a plurality of openings 130, 132 are defined, which can be identical or different from each other in shape or size. Although such positioning is perpendicular to the lower longitudinal portion of the leg portion 126 and the upper longitudinal portion of the leg portion 126, other angle configurations are possible, such as acute or obtuse. Note that the openings 130, 132 are shaped based on how the column 128 is angled. Alternatively, the column 128 can be lacking and a single opening within the leg portion 126 exists, which includes the openings 130, 132. Also, the column 128 can be lacking and the leg portion 126 is solid, with no openings 130, 132. Also, the column 128 can be replaced with a bridge spanning longitudinally across the leg portion 128 to bolster support. Further, more than one column 128 can be used to even further bolster support.

The leg portion 126 can include at least one of a mesh, a net, or a lattice coupled or unitary thereto. At least one of the mesh, the net, or the lattice can contain at least one of metal, wood, plastic, rubber, glass, stone, cloth, fabric, fiber, or another suitable material. At least one of the mesh, the net, or the lattice can cover openings 130, 132 from the lower longitudinal portion of the leg portion 126 and the upper longitudinal portion of the leg portion 126.

The platform frame, as described above, and the leg portion 126 are in a T-shaped relationship with each other, where the platform frame is a platform of the T-shape and the leg portion 126 is a leg of the T-shape. For example, the platform frame and the leg portion 126 are substantially perpendicular to each other, such as about ninety (90) degrees. However, note that other embodiments are foreseeable where such angling is different, whether obtuse or acute.

Based on the T-shaped relationship, the first frame section 102 and the leg portion 126 are in an L-shape relationship with each other, where the first frame section 102 is a base of the L-shape and the leg portion 126 is a column of the L-shape. Similarly, the second frame section 112 and the leg portion 126 are in an L-shape relationship with each other, where the second frame section 112 is a base of the L-shape and the leg portion 126 is a column of the L-shape.

Although the platform frame and the leg portion 126 can be one-piece, such as unitary via molding, additive manufacturing, subtractive manufacturing, or any other suitable manner, the platform frame and the leg portion 126 can also be assembled with each other, such as via the platform frame and the leg portion 126 coupling to each other. Such assembly can be via any manner of coupling, such as fastening, mating, interlocking, adhering, clamping, bracketing, tying, or any other suitable manner. For example, whether as one-piece or as an assembly, the platform frame and the leg portion 126 are in the T-shaped relationship based on the platform frame spine extending from the leg portion 126.

As shown in FIG. 1, the platform frame, which is defined via the first frame section 102 and the second frame section 112, and the leg portion 126 can be assembled to be in the T-shaped relationship based on the platform frame spine, which is defined via the inner longitudinal element 104 and the inner longitudinal element 114, securely contacting the leg portion 126. Such secure contact is enabled via a plurality of fasteners 134, 136 fastening through the upper longitudinal portion of the leg portion 126 into the platform frame spine, whether perpendicular or non-perpendicular to at least one of the inner longitudinal element 104 or the inner longitudinal element 114. For example, at least one of the fasteners can comprise a screw or a bolt. Note that such fastening can be into any portion of the platform frame spine, such as at least one of the inner longitudinal element 104 or the inner longitudinal element 114. Also, note that nuts can be used to thread onto the fasteners 134, 136 to further secure the platform frame spine to the leg portion 126. For example, at least one of the nuts can include a torus-shaped nut or a wing nut. Alternatively, a set of pegs or maters can be used to couple the platform frame spine to the leg portion 126.

A U-shaped bracket 137 is defined via a base and a pair of walls extending from the base, whether perpendicularly or non-perpendicularly. The base defines one or more bores which is circular in shape and threaded, but can be at least one of non-circular or non-threaded. The one or more bores extend fully through the base. The base is solid, but can be slotted or perforated.

In the bracket 137, each of the walls defines a plurality of U-shaped slots along a longitudinal plane, whether identical to or different from each other in shape or size. Alternatively, at least one of the U-shaped slots can be defined via the base and two adjacent wall portions on one side of the base, such as when the two adjacent wall portions are aligned along a longitudinal plane of the base. For each respective wall, the slots are structured to receive the lateral elements 106 or 116, while the longitudinal elements 104 and 114 are positioned adjacent to each other between the walls and above the base. In other embodiments, the slots are not U-shaped, such as O-shaped or D-shaped.

The bed frame 100 can also include a headboard frame 138. The headboard frame 138 is defined via a plurality of longitudinal elements 140, a lateral element 142, a plurality of lateral units 144, 146, a headboard frame spine 148, and a U-shaped member 156. For example, the headboard frame 138 is inclined from about 90 degrees to about 180 degrees with respect to the platform frame. Preferably, such inclination is from about 110 degrees to about 160 degrees.

At least one of the longitudinal elements 140 can be a beam, a shaft, or a bar of any cross section, whether solid or hollow internally, whether one-piece or an assembly. At least one of the longitudinal elements 140 contains at least one of metal, wood, plastic, rubber, glass, stone, or another suitable material. The longitudinal elements 140 extend in parallel to each other, but can be non-parallel as well, whether converging or diverging. At least one of the longitudinal elements 140 extends rectilinearly, but can extend in other manners, such as sinusoidal, arcuate, pulse-shaped, zigzag, or any other manner. The longitudinal elements 140 can be configured identical to or different from each other in any manner, whether in whole or in part, whether in structure, shape, function, material, size, component, or any other aspect.

The lateral element 142 can be a beam, a shaft, or a bar of any cross section, whether solid or hollow internally, whether one-piece or an assembly. The lateral element 142 contains at least one of metal, wood, plastic, rubber, glass, stone, or another suitable material. The lateral element 142 extends rectilinearly, but can extend in other manners, such as sinusoidal, arcuate, pulse-shaped, zigzag, or any other manner. The lateral element 142 spans between the longitudinal elements 140 such that a U-shape a defined thereby. Alternatively, a C-shape can be defined thereby. Alternatively, the lateral element 142 is lacking and the longitudinal elements 140 extend from each other such that a V-shape is defined thereby. Alternatively, the longitudinal elements 140 extend from each other such that a portion of a Y-shape is defined thereby, with a leg of the Y-shape extending from a meeting point of the longitudinal elements 140. The lateral element 142 is perpendicular to the longitudinal elements 140. Alternatively, the lateral element 142 is non-perpendicular to at least one of the longitudinal elements 140, whether obtusely or acutely angled. The lateral element 142 can be one-piece with at least one of the longitudinal elements 140 or be assembled therewith.

At least one of the lateral units 144, 146 can be a beam, a shaft, or a bar of any cross section, whether solid or hollow internally, whether one-piece or an assembly. At least one of the lateral units 144, 146 contains at least one of metal, wood, plastic, rubber, glass, stone, or another suitable material. At least one of the lateral units 144, 146 extends rectilinearly, but can extend in other manners, such as sinusoidal, arcuate, pulse-shaped, zigzag, or any other manner. The lateral units 144, 146 extend toward each other from the longitudinal elements 140. Such extension is perpendicular such that the respective lateral units 144, 146 and the respective longitudinal elements 140 are in respective L-shaped relationships with each other. However, note that such extension can also be non-perpendicular, whether acutely or obtusely angled. The lateral units 144, 146 extend parallel to the lateral element 142, but non-parallel extension for at least one of the lateral units 144, 146 is possible. At least one of the lateral units 144, 146 can be one-piece with at least one of the longitudinal elements 140 or be assembled therewith. Note that at least one longitudinal element 140 can span between at least one of the lateral units 144, 146 and the lateral element 142, whether parallel or non-parallel to at least one of the one longitudinal elements 140.

The headboard frame spine 148 can be a beam, a shaft, or a bar of any cross section, whether solid or hollow internally, whether one-piece or an assembly. The headboard frame spine 148 contains at least one of metal, wood, plastic, rubber, glass, stone, or another suitable material. The headboard frame spine 148 extends in parallel to the longitudinal elements 140 such that the longitudinal elements 140 and the headboard frame spine 148 are E-shaped. However, note that non-parallel extension is possible, whether converging or diverging. The headboard frame spine 148 can be one-piece with at least one of the longitudinal elements 140 or be assembled therewith The U-shaped member 156 can be a beam, a shaft, or a bar of any cross section, whether solid or hollow internally, whether one-piece or an assembly. The U-shaped member 156 contains at least one of metal, wood, plastic, rubber, glass, stone, or another suitable material. A pair of ends of the U-shaped member 156 extend from the lateral units 144, 146, while the headboard frame spine 148 spans between the lateral element 142 and a base of the U-shaped member 156. Note that a pair of respective columns of the U-shaped member 156 and the respective lateral units 144, 146 are in a pair of respective L-shaped relationships with each other. The headboard frame spine 148 and the U-shaped member 156 are in a Y-shaped relationship with each other. The U-shaped member defines an interior channel 154, such as a slot. The headboard frame spine 148 can be one-piece with the base of the U-shaped member 156 or be assembled therewith. Likewise, at least one of the ends of the U-shaped member 156 can be one-piece with at least one of the longitudinal elements 140 or be assembled therewith. Note that at least one longitudinal element 140 can span between at least the lateral element 142 and the U-shaped member 156, whether parallel or non-parallel to at least one of the one longitudinal elements 140.

The headboard frame 138 defines a pair of open spaces 150, 152 via the longitudinal elements 140, the lateral element 142, the lateral units 144, 146, the headboard frame spine 148, and the U-shaped member 156. Alternatively, the headboard frame 138 lacks the open spaces 150, 152 and is therefore solid.

Although the platform frame and the headboard frame 138 can be one-piece, such as unitary via molding, additive manufacturing, subtractive manufacturing, or any other suitable manner, the platform frame and the headboard frame 138 can also be assembled with each other, such as via any manner of coupling, such as fastening, mating, interlocking, adhering, clamping, bracketing, tying, or any other suitable manner.

As shown in FIG. 1, the platform frame and the headboard frame 138 are coupled to each other via fastening with a fastener 158 through a pair of complementary bores uniquely extending through the columns of the U-shaped member 156, the bore 110, and the bore 120. The set of bores in the U-shaped member 156 is complementary via bore alignment, such as via opposing each other, while extending parallel to the lateral element 142. However, note that such alignment can also be offset, such as via extending non-parallel to the lateral element 142. The set of bores is circular in shape and threaded, but can be at least one of non-circular or non-threaded. The fastener 158 comprises at least one of a screw or a bolt. Note that a nut can be used to thread onto the fastener 158 to further secure the platform frame and the headboard frame 138. For example, at least one of the nuts can include a torus-shaped nut or a wing nut. Alternatively, a set of pegs or maters can be used to couple the platform frame and the headboard frame 138. Note that when the platform frame and the headboard frame 138 are coupled to each other, a portion of the platform frame spine, which is positioned between two of the lateral elements 106 and two of the lateral elements 116, is positioned within the interior channel 154 of the U-shaped member 156. Such positioning can be snug or non-snug to the columns of the U-shaped member 156. Also, such positioning can allow the portion of the platform frame spine to in contact with or be contactless with the base of the U-shaped member 156.

Figure 2:
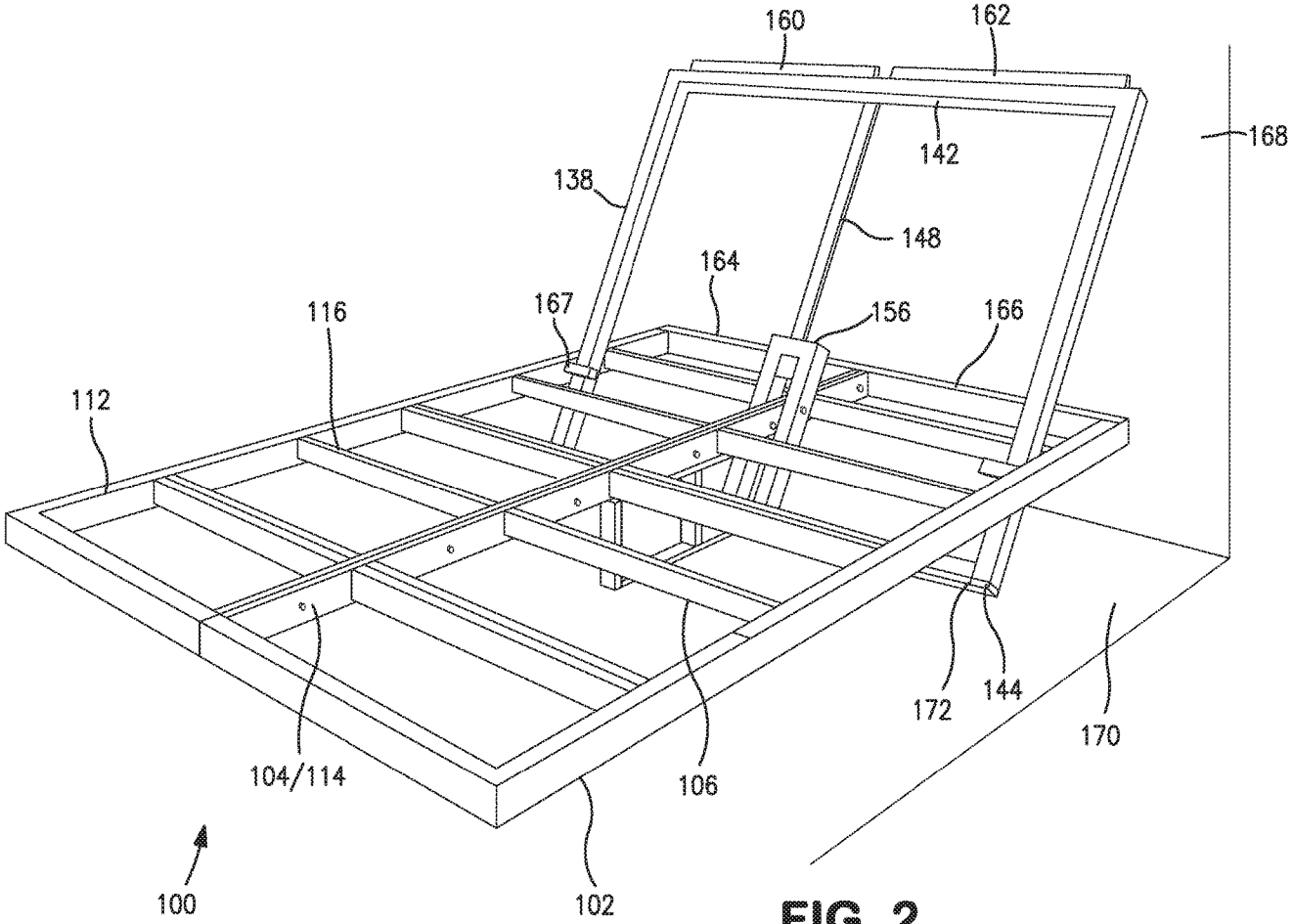
FIG. 2 shows an perspective view of an assembled bed frame, according to an embodiment of the present disclosure.

FIG. 2 shows an perspective view of an assembled bed frame, according to an embodiment of the present disclosure. Some elements of this figure are described above. Thus, same reference characters identify identical and/or like components described above and any repetitive detailed description thereof will hereinafter be omitted or simplified in order to avoid complication.

The first frame section 102 and the second frame section 112 are one-piece and thereby define the platform frame, which contains the platform frame spine 104/114. Each of the first frame section 102 and the second frame section 112 includes an end lateral element 164, 166. Each of the end lateral elements 164, 166 is positioned in a head section of the platform frame. The platform frame spine 104/114 or at least one of the end lateral elements 164, 166 is configured to couple to a surface or a wall, either of which can be horizontal, vertical, or diagonal, whether rectilinear, sinusoidal, arcuate, pulse-shaped, zigzag, or any other manner, whether one-piece or an assembly, whether can comprise at least one of metal, wood, plastic, rubber, glass, stone, or another suitable material. For example, such wall can be a building wall 168. Such coupling can be via any manner of coupling, such as fastening, mating, interlocking, adhering, clamping, bracketing, tying, or any other suitable manner. For example, for fastening, the platform frame spine 104/114 or at least one of the end lateral elements 164, 166 can contain a bore through which a fastener, such as a bolt or a screw, can extend to secure to the surface.

The platform frame also includes one or more bars 167, which extends from at least one of the longitudinal members 104, 114 toward the platform frame spine 104/114. The one or more bars 167 extends to engage the headboard frame 138 such that to the headboard frame 138 further securely rests or unable to slide uncontrollably to effectively reduce see-saw action of the headboard frame 138. The one or more bars 167 can be fixedly extending from at least one of the longitudinal members 104, 114 or be retractable, telescoping, or pivoting therefrom. Such extension can be rectilinear, sinusoidal, arcuate or other. Also, such extension can be perpendicular to at least one of the longitudinal members 104, 114 or be non-perpendicular thereto, whether acutely or obtusely angled. The one or more bars 167 can be solid or hollow internally, whether one-piece or an assembly, of any cross-section. The one or more bars 167 contains at least one of metal, wood, plastic, rubber, glass, stone, or another suitable material. The one or more bars 167 can one-piece with at least one of the longitudinal members 104, 114 or be an assembly therewith, such as via any manner of coupling, such as fastening, mating, interlocking, adhering, clamping, bracketing, tying, or any other suitable manner.

The headboard frame 138 includes a pair of bars 160, 162, which extend along the lateral element 142. For example, at least one of the bars 160, 162 can be an angled cap. At least one of the bars 160, 162 can be solid or hollow internally, whether one-piece or an assembly, of any cross-section. At least one of the bars 160, 162 contains at least one of metal, wood, plastic, rubber, glass, stone, or another suitable material. The bars 160, 162 can be identical to or different from each other in any characteristic, such as size, shape, material, structure, function, or any other characteristic. At least one of the bars 160, 162 can be one-piece with the lateral element 142 or assembled therewith, such as via any manner of coupling, such as fastening, mating, interlocking, adhering, clamping, bracketing, tying, or any other suitable manner. Alternatively, a single bar 160, 162 can be used, which can overlie the headboard frame spine 148. At least one of the bars 160, 162 is configured to couple to a surface or a wall, either of which can be horizontal, vertical, or diagonal, whether rectilinear, sinusoidal, arcuate, pulse-shaped, zigzag, or any other manner, whether one-piece or an assembly, whether can comprise at least one of metal, wood, plastic, rubber, glass, stone, or another suitable material. For example, such wall can be the building wall 168. Such coupling can be via any manner of coupling, such as fastening, mating, interlocking, adhering, clamping, bracketing, tying, or any other suitable manner. For example, for fastening, at least one of the bars 160, 162 can contain a bore through which a fastener, such as a bolt or a screw, can extend to secure to the surface. Alternatively, the lateral element 142 is configured to couple to the surface or the wall. Although FIG. 1 depicts the platform frame spine 104/114 or at least one of the end lateral elements 164, 166, and the bars 160, 162 coupling to the building wall 168, in other embodiments, the platform frame spine 104/114 or at least one of the end lateral elements 164, 166 couple to one surface or wall, while at least one of the bars 160, 162 couple to another surface of wall.

The leg portion 126 stands on a surface or a floor 170 and supports the platform frame thereon. The surface or the floor 170 can be horizontal, vertical, or diagonal, whether rectilinear, sinusoidal, arcuate, pulse-shaped, zigzag, or any other manner, whether one-piece or an assembly, whether can comprise at least one of metal, wood, plastic, rubber, glass, stone, or another suitable material.

At least one of the lateral units 144, 146 includes an angled cap 172, which can engage the surface or the floor 170 to increase friction or grip. The angled cap 172 can be solid or hollow internally, whether one-piece or an assembly, of any cross-section. The angled cap 172 contains at least one of metal, wood, plastic, rubber, glass, stone, or another suitable material. If more than one the angled cap 172 is used, then the angled caps 172 can be identical to or different from each other in any characteristic, such as size, shape, material, structure, function, or any other characteristic. The angled cap 172 can be one-piece with least one of the lateral units 144, 146 or be assembled therewith, such as via any manner of coupling, such as fastening, mating, interlocking, adhering, clamping, bracketing, tying, or any other suitable manner. Alternatively, a single angled cap 172 spanning between the lateral units 144, 146 can be used, which can be mounted after the headboard frame 138 is installed onto the platform frame. In other embodiments, the angled cap 172 can be configured to couple to a surface or a wall, either of which can be horizontal, vertical, or diagonal, whether rectilinear, sinusoidal, arcuate, pulse-shaped, zigzag, or any other manner, whether one-piece or an assembly, whether can comprise at least one of metal, wood, plastic, rubber, glass, stone, or another suitable material. Such coupling can be via any manner of coupling, such as fastening, mating, interlocking, adhering, clamping, bracketing, tying, or any other suitable manner. For example, for fastening, the angled cap 172 can contain a bore through which a fastener, such as a bolt or a screw, can extend to secure to the surface.

Figure 3:
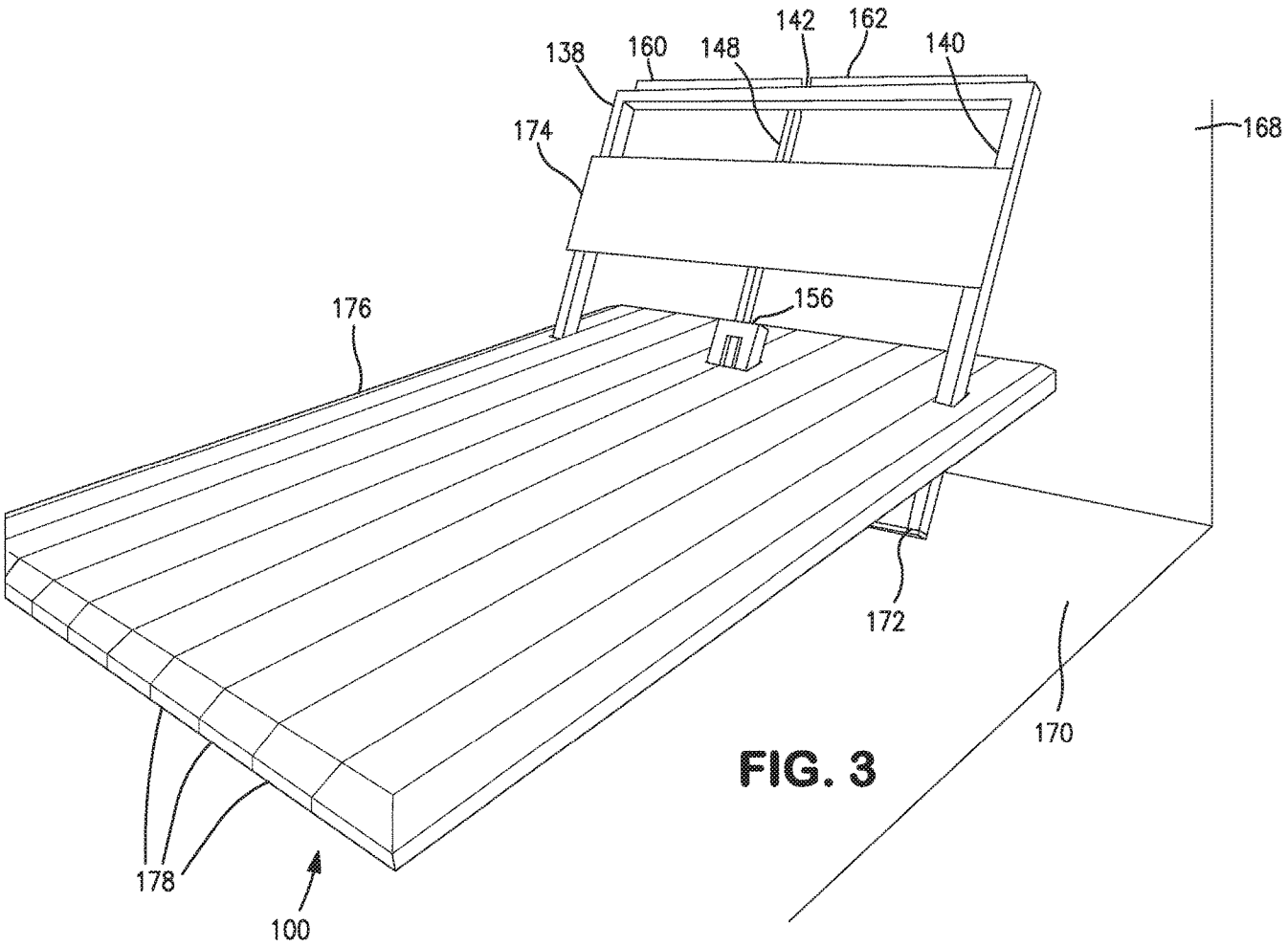
FIG. 3 shows a perspective view of a bed platform supported by an assembled bed frame, according to an embodiment of the present disclosure.

FIG. 3 shows a perspective view of a bed platform supported by an assembled bed frame, according to an embodiment of the present disclosure. Some elements of this figure are described above. Thus, same reference characters identify identical and/or like components described above and any repetitive detailed description thereof will hereinafter be omitted or simplified in order to avoid complication.

The headboard frame 138 contains a support board 174 spanning between the longitudinal elements 140 and over the headboard frame spine 148, which can extend past the longitudinal elements 140. Alternatively, the support board 174 spans between one of the longitudinal elements 140 and the headboard frame spine 148. Alternatively, the support board 174 is cantilevered from one of the longitudinal elements 140 or the headboard frame spine 148. The support board 174 can be solid, perforated, latticed, or any other type. The support board 174 can be solid or hollow internally, whether one-piece or an assembly, such as via any manner of coupling, such as fastening, mating, interlocking, adhering, clamping, bracketing, tying, or any other suitable manner, of any cross-section. The support board 174 contains at least one of metal, wood, plastic, rubber, glass, stone, or another suitable material. The support board 174 can be one-piece with any component defining the headboard frame 138 or be assembled therewith, such as via any manner of coupling, such as fastening, mating, interlocking, adhering, clamping, bracketing, tying, or any other suitable manner. The support board 174 can be configured to couple to a surface or a wall, either of which can be horizontal, vertical, or diagonal, whether rectilinear, sinusoidal, arcuate, pulse-shaped, zigzag, or any other manner, whether one-piece or an assembly, whether can comprise at least one of metal, wood, plastic, rubber, glass, stone, or another suitable material. Such coupling can be via any manner of coupling, such as fastening, mating, interlocking, adhering, clamping, bracketing, tying, or any other suitable manner. For example, for fastening, the support board 174 can contain a bore through which a fastener, such as a bolt or a screw, can extend to secure to the surface.

The platform frame supports a platform 176, which is defined via a plurality of slats 178 positioned immediately adjacent to each other. Alternatively, the platform 176 is one-piece. Also alternatively, the slats 178 can be positioned non-immediate to each other, such as via defining one or more open slots therebetween, which can overlap one or more of other slats positioned below, for any purpose. For example, the slats 178 can be positioned non-immediate to each other, while being coupled to each other via one or more bridges spanning between the slats 178, over one or more of the open slots.

The platform 176 is configured to accommodate the U-shaped member 156, such as via defining an opening within the platform 176. The platform 176 also extends longitudinally from the building wall 168. However, the platform 176 can also extend less than such or more than such, for example, through the building wall 168. The platform 176 can contact the building wall 168 or be contactless therewith.

The platform 176 can be solid, perforated, latticed, grid-shaped, or any other type. The platform 176 can be solid or hollow internally. The platform 176 can be non-slat based. The platform 176 contains at least one of metal, wood, plastic, rubber, glass, stone, or another suitable material. The platform 176 can be one-piece with any component defining the platform frame or the headboard frame 138 or be assembled with any of therewith, such as via any manner of coupling, such as fastening, mating, interlocking, adhering, clamping, bracketing, tying, or any other suitable manner.

The platform 176 can be configured to couple to a surface or a wall, either of which can be horizontal, vertical, or diagonal, whether rectilinear, sinusoidal, arcuate, pulse-shaped, zigzag, or any other manner, whether one-piece or an assembly, whether comprising at least one of metal, wood, plastic, rubber, glass, stone, or another suitable material. Such coupling can be via any manner of coupling, such as fastening, mating, interlocking, adhering, clamping, bracketing, tying, or any other suitable manner. For example, for fastening, the platform 176 can contain a bore through which a fastener, such as a bolt or a screw, can extend to secure to the surface.

The slats 178 can secure to or engage each other, such as via fastening, mating, interlocking, adhering, clamping, bracketing, tying, or any other suitable manner. Alternatively, the slats 178 do not secure to or engage each other, but are positioned immediately adjacent to each other. The slats 178 can be identical to or different from each other in any characteristic, such as size, shape, material, structure, function, orientation, or any other characteristic. At least one of the slats 178 is longitudinally rectilinear, but other extensions are possible, such as sinusoidal, arcuate, pulse-shaped, zigzag, or another type of extension. At least one of the slats 178 is configured to accommodate the U-shaped member 156, such as via defining an opening within the at least one of the slats 178. At least one of the slats 178 can also extends longitudinally from the building wall 168. However, at least one of the slats 178 can also extend less than such or more than such, for example, through the building wall 168. At least one of the slats 178 can contact the building wall 168 or be contactless therewith. At least one of the slats 178 can be solid, perforated, latticed, or any other type. At least one of the slats 178 can be solid or hollow internally, whether one-piece or an assembly, such as via any manner of coupling, such as fastening, mating, interlocking, adhering, clamping, bracketing, tying, or any other suitable manner, of any cross-section. At least one of the slats 178 contains at least one of metal, wood, plastic, rubber, glass, stone, or another suitable material. At least one of the slats 178 can be one-piece with any component defining the platform frame or the headboard frame 138 or be assembled with any of therewith, such as via any manner of coupling, such as fastening, mating, interlocking, adhering, clamping, bracketing, tying, or any other suitable manner. At least one of the slats 178 can be configured to couple to a surface or a wall, either of which can be horizontal, vertical, or diagonal, whether rectilinear, sinusoidal, arcuate, pulse-shaped, zigzag, or any other manner, whether one-piece or an assembly, whether comprising at least one of metal, wood, plastic, rubber, glass, stone, or another suitable material. Such coupling can be via any manner of coupling, such as fastening, mating, interlocking, adhering, clamping, bracketing, tying, or any other suitable manner. For example, for fastening, at least one of the slats 178 can contain a bore through which a fastener, such as a bolt or a screw, can extend to secure to the surface.

Figure 4:
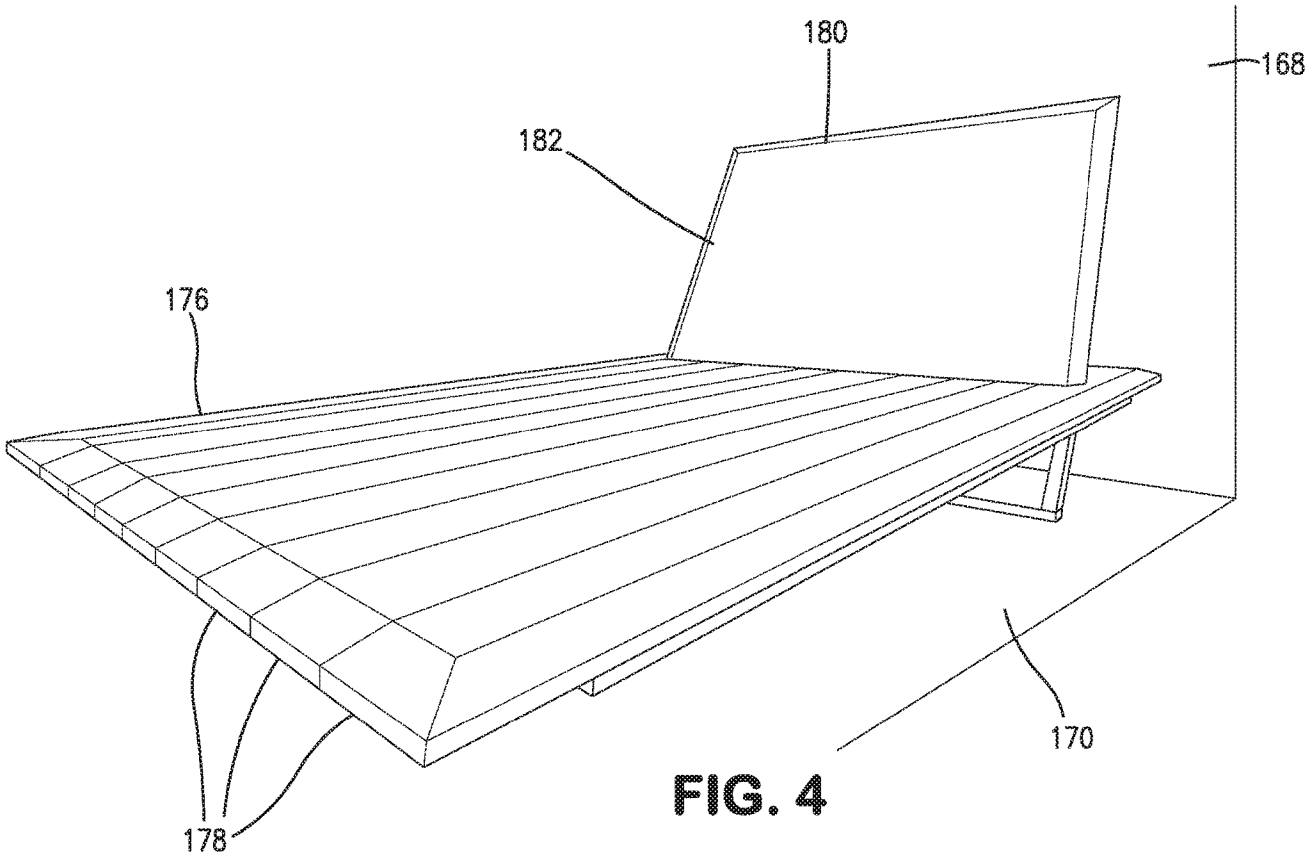
FIG. 4 shows a perspective view of a headboard engaging a bed platform supported by an assembled bed frame, according to an embodiment of the present disclosure.

FIG. 4 shows a perspective view of a headboard engaging a bed platform supported by an assembled bed frame, according to an embodiment of the present disclosure. Some elements of this figure are described above. Thus, same reference characters identify identical and/or like components described above and any repetitive detailed description thereof will hereinafter be omitted or simplified in order to avoid complication.

The headboard frame 138 supports a headboard 180, which is defined via a plurality of slats 182 positioned immediately adjacent to each other. Alternatively, the headboard 180 is one-piece. Also alternatively, the slats 182 can be positioned non-immediate to each other, such as via defining one or more open slots therebetween, which can overlap one or more of other slats positioned below, for any purpose. For example, the slats 182 can be positioned non-immediate to each other, while being coupled to each other via one or more bridges spanning between the slats 182, over one or more of the open slots.

The headboard 180 extends laterally along the building wall 168. However, the headboard 180 can also extend through the building wall 168, such as via an arcuate extension. The headboard 180 can contact the building wall 168 or be contactless therewith.

The headboard 180 can be solid, perforated, latticed, grid-shaped, or any other type. The headboard 180 can be solid or hollow internally. The headboard 180 can be non-slat based. The headboard 180 contains at least one of metal, wood, plastic, rubber, glass, stone, or another suitable material. The headboard 180 can be one-piece with any component defining the platform frame or the headboard frame 138 or be assembled with any of therewith, such as via any manner of coupling, such as fastening, mating, interlocking, adhering, clamping, bracketing, tying, or any other suitable manner. The headboard 180 is shaped in a rectangular manner, but can be shaped differently, such as circular, triangular, square, pentagonal, star, trapezoid, or others.

The headboard 180 can be configured to couple to a surface or a wall, either of which can be horizontal, vertical, or diagonal, whether rectilinear, sinusoidal, arcuate, pulse-shaped, zigzag, or any other manner, whether one-piece or an assembly, whether comprising at least one of metal, wood, plastic, rubber, glass, stone, or another suitable material. Such coupling can be via any manner of coupling, such as fastening, mating, interlocking, adhering, clamping, bracketing, tying, or any other suitable manner. For example, for fastening, the headboard 180 can contain a bore through which a fastener, such as a bolt or a screw, can extend to secure to the surface.

The slats 182 can secure to or engage each other, such as via fastening, mating, interlocking, adhering, clamping, bracketing, tying, or any other suitable manner. Alternatively, the slats 182 do not secure to or engage each other, but are positioned immediately adjacent to each other. The slats 182 can be identical to or different from each other in any characteristic, such as size, shape, material, structure, function, orientation, or any other characteristic. At least one of the slats 182 is longitudinally rectilinear, but other extensions are possible, such as sinusoidal, arcuate, pulse-shaped, zigzag, or another type of extension. At least one of the slats 182 can also extend along the building wall 168. However, at least one of the slats 182 can also extend through the building wall 168. At least one of the slats 182 can contact the building wall 168 or be contactless therewith. At least one of the slats 182 can be solid, perforated, latticed, or any other type. At least one of the slats 182 can be solid or hollow internally, whether one-piece or an assembly, such as via any manner of coupling, such as fastening, mating, interlocking, adhering, clamping, bracketing, tying, or any other suitable manner, of any cross-section. At least one of the slats 182 contains at least one of metal, wood, plastic, rubber, glass, stone, or another suitable material. At least one of the slats 182 can be one-piece with any component defining the platform frame or the headboard frame 138 or be assembled with any of therewith, such as via any manner of coupling, such as fastening, mating, interlocking, adhering, clamping, bracketing, tying, or any other suitable manner. At least one of the slats 182 can be configured to couple to a surface or a wall, either of which can be horizontal, vertical, or diagonal, whether rectilinear, sinusoidal, arcuate, pulse-shaped, zigzag, or any other manner, whether one-piece or an assembly, whether comprising at least one of metal, wood, plastic, rubber, glass, stone, or another suitable material. Such coupling can be via any manner of coupling, such as fastening, mating, interlocking, adhering, clamping, bracketing, tying, or any other suitable manner. For example, for fastening, at least one of the slats 182 can contain a bore through which a fastener, such as a bolt or a screw, can extend to secure to the surface.

Figure 5:
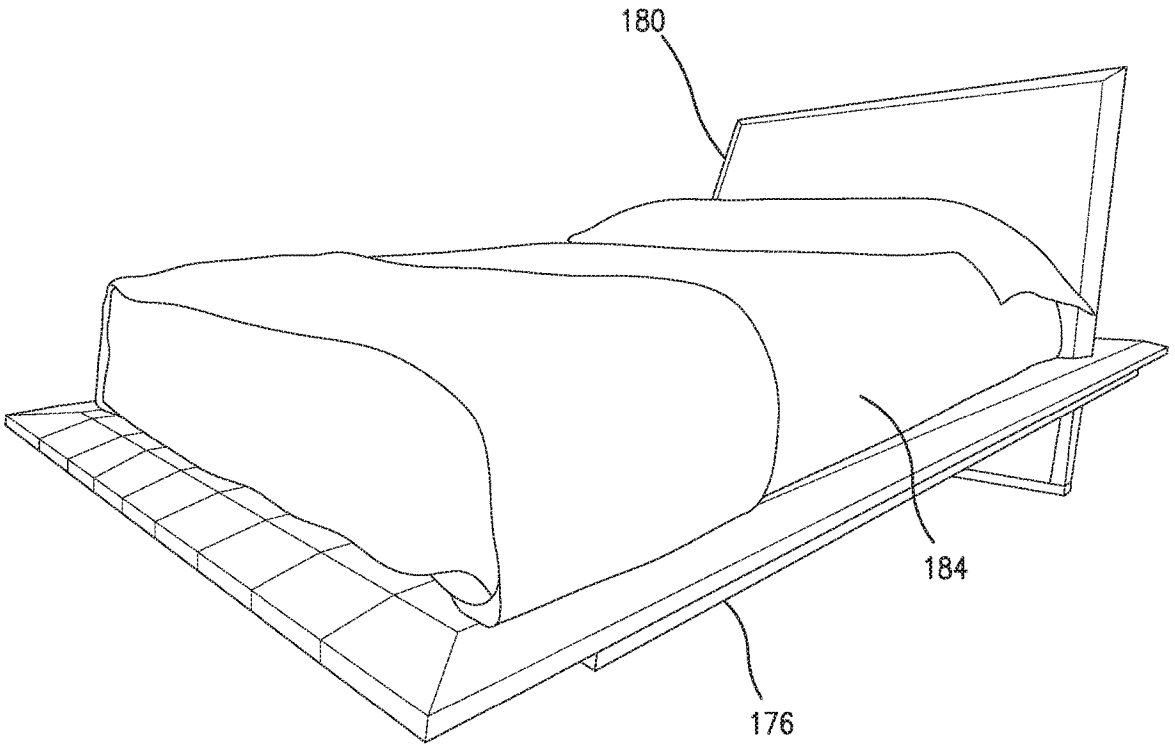
FIG. 5 shows a perspective view of a mattress with a bedding, with the mattress being supported by a bed with a headboard engaging a bed platform which is supported by an assembled bed frame, according to an embodiment of the present disclosure.

FIG. 5 shows a perspective view of a mattress with a bedding, with the mattress being supported by a bed with a headboard engaging a bed platform which is supported by an assembled bed frame, according to an embodiment of the present disclosure. Some elements of this figure are described above. Thus, same reference characters identify identical and/or like components described above and any repetitive detailed description thereof will hereinafter be omitted or simplified in order to avoid complication.

The platform 176 supports a mattress 184 thereon. The mattress 184 can be of any type, such as an inner spring mattress, a foam mattress, a bladder mattress, or any other type of mattress for any use, such as for adult bedroom use, crib/toddler use, cot use, hospital use, nursing home use, hotel use, dormitory use, or any other type of use. Note that more than one mattress 184 can be supported by the platform 176, such as a box-spring foundation and an innerspring mattress 184 resting thereon. Also, the mattress 184 can be of any size, such as a single size, a queen size, a king size, or any other size.

Figure 6:
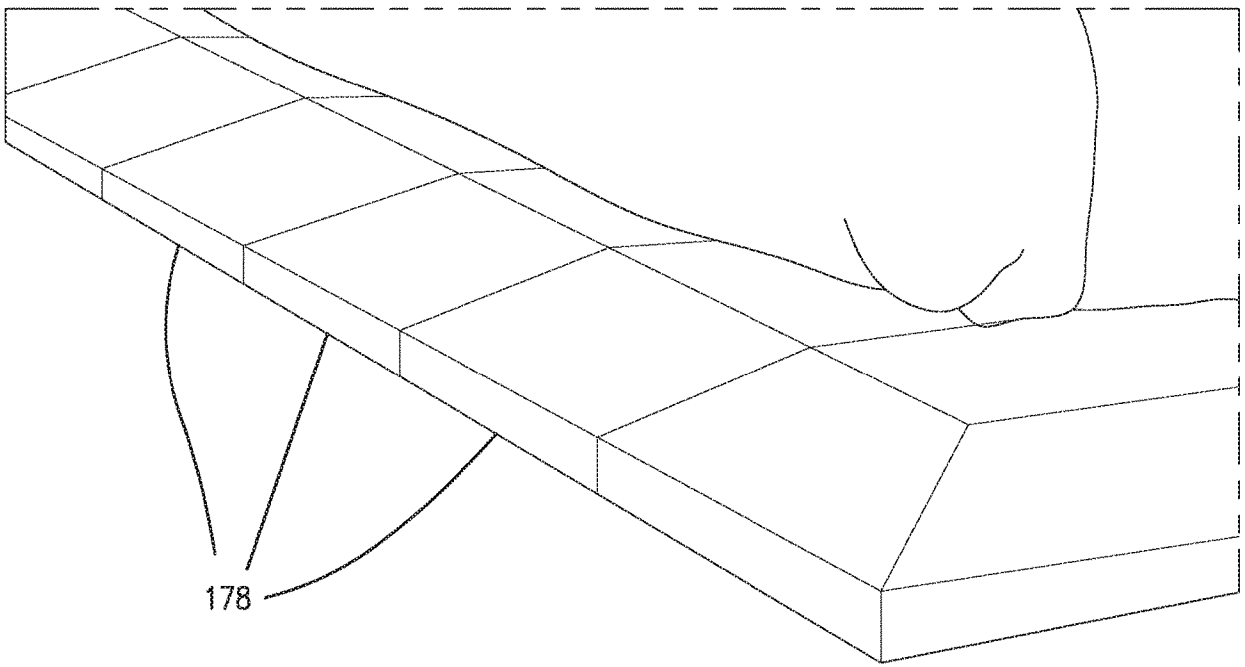
FIG. 6 shows a close-up, perspective view of a bed platform supporting a mattress with a bedding, with the bed platform being defined via a plurality of slats, according to an embodiment of the present disclosure.

FIG. 6 shows a close-up, perspective view of a bed platform supporting a mattress with a bedding, with the bed platform being defined via a plurality of slats, according to an embodiment of the present disclosure. Some elements of this figure are described above. Thus, same reference characters identify identical and/or like components described above and any repetitive detailed description thereof will hereinafter be omitted or simplified in order to avoid complication.

The slats 178 are positioned immediately adjacent to each other longitudinally and along a horizontal plane. The slats 178 extend longitudinally in a rectilinear manner along the horizontal plane. At least one of the slats 178 can include a longitudinal edge, which can be angled. For example, the longitudinal edge can be beveled or chamfered.

Figure 7:
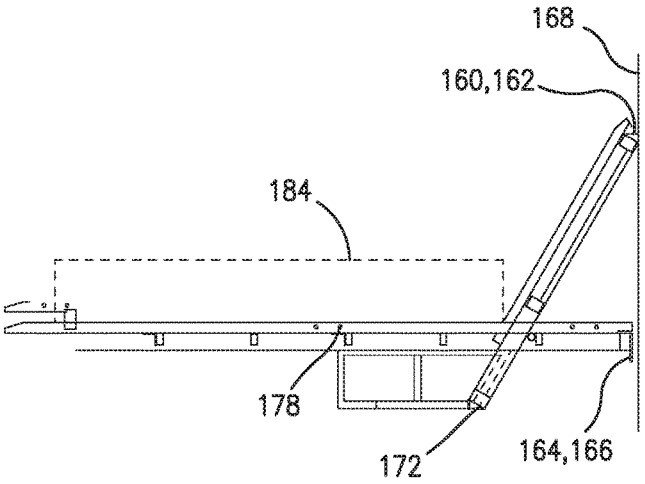
FIG. 7 shows a right side, schematic view of a bed platform, according to an embodiment of the present disclosure.
Figure 8:
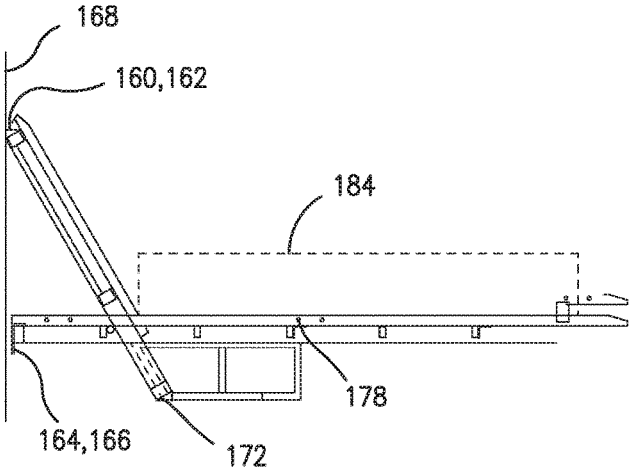
FIG. 8 shows a left side, schematic view of a bed platform, according to an embodiment of the present disclosure.

FIG. 7 shows a left side, schematic view of a bed platform, according to an embodiment of the present disclosure. FIG. 8 shows a right side, schematic view of a bed platform, according to an embodiment of the present disclosure. Some elements of this figure are described above. Thus, same reference characters identify identical and/or like components described above and any repetitive detailed description thereof will hereinafter be omitted or simplified in order to avoid complication.

At least two of the slats 178 mate with each other. Such mating occurs via one of such slats 178 including a dowel extending therefrom and the other of such slats 178 defining a bore therein, which can be stopped, such as a well, where the dowel engages the bore. The dowel can extend in a perpendicular manner or a non-perpendicular manner, such obtusely or acutely angled. The corresponding bore is oriented for receiving the dowel. Such mating enables attachment or alignment between the two of the slats 178. The dowel can be fixedly extending from one of the slats 178 or be retractable, telescoping, or pivoting therefrom. Such extension can be rectilinear, sinusoidal, arcuate or other. The dowel can be solid or hollow internally, whether one-piece or an assembly, of any cross-section. The dowel contains at least one of metal, wood, plastic, rubber, glass, stone, or another suitable material. The dowel can one-piece with the one of the slats 178 or be an assembly therewith, such as via any manner of coupling, such as fastening, mating, interlocking, adhering, clamping, bracketing, tying, or any other suitable manner.

In other embodiments, any part of the bed frame 100, the platform 176, or the headboard 180 includes at least one of a processing device, an energy storage device, or a display device. For example, the processing device includes a processing circuit or a hardware processor, which can be multicore. For example, the energy storage device includes a battery, such as alkaline, lithium, or liquid, or a capacitor. For example, the display device includes a light source, such as a bulb or a visual presentation display, which can be electronic. Note that any part of the bed frame 100, the platform 176, or the headboard 180 can also support or be coupled to a wire, such as a copper wire.

Figure 9:
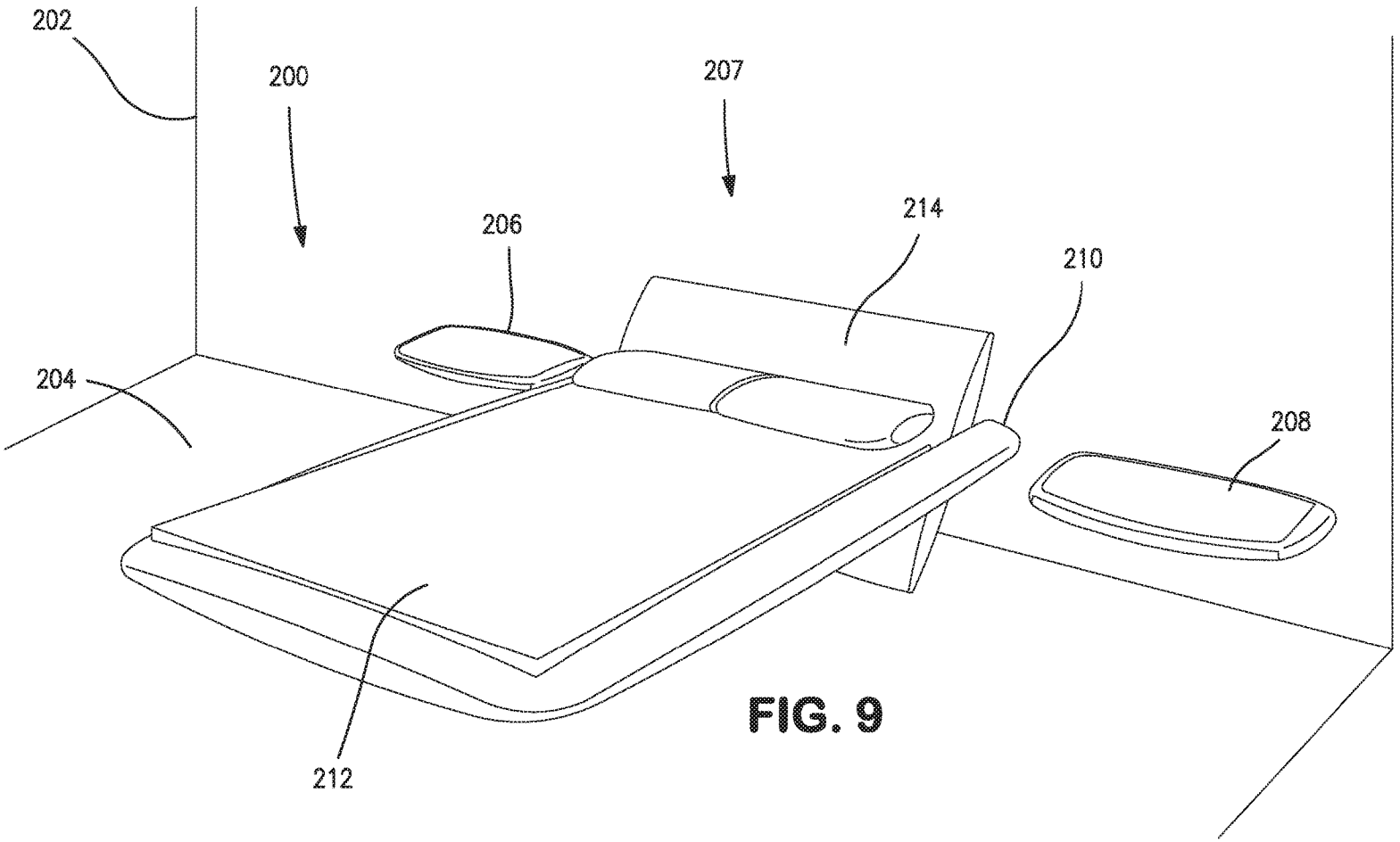
FIG. 9 shows a perspective view of a pair of tables and a bed secured to a wall, with the bed being positioned between the tables, according to an embodiment of the present disclosure.
Figure 10A:
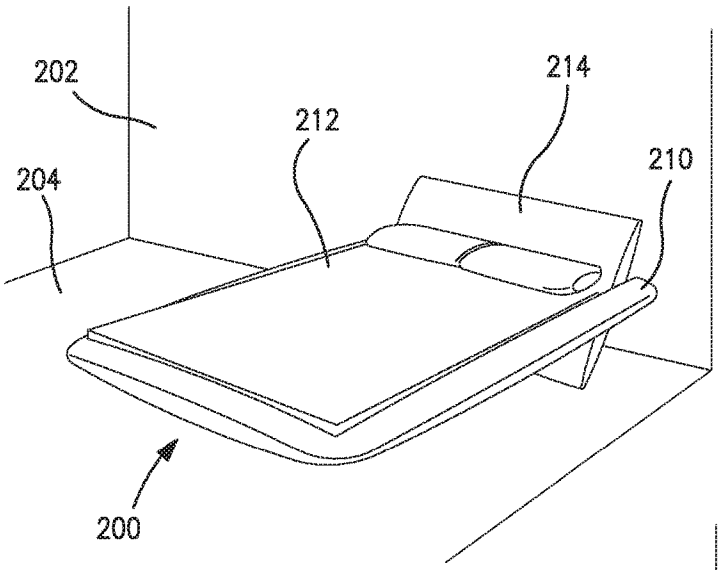
FIG. 10A shows a perspective view of a bed in a slide-in state, according to an embodiment of the present disclosure.
Figure 10B:
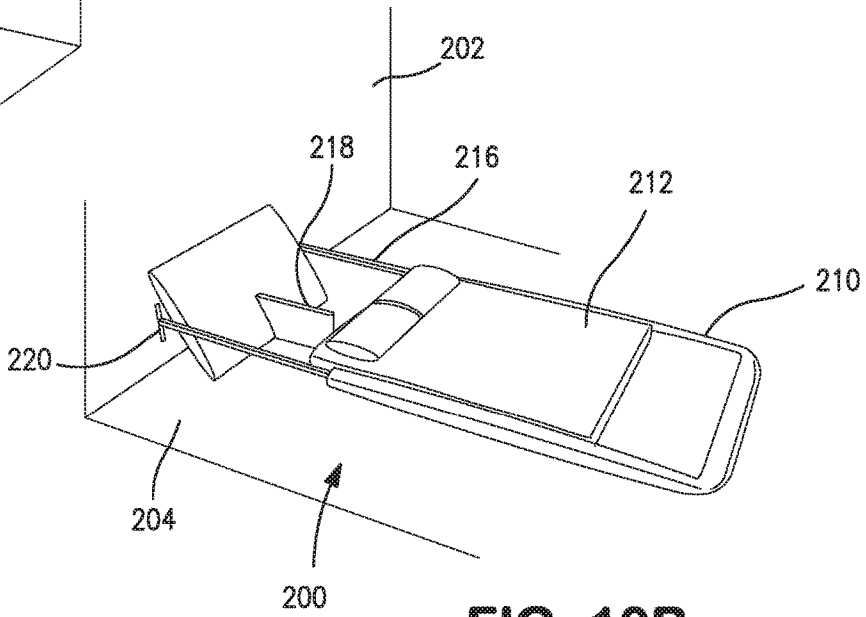
FIG. 10B shows a perspective view of a bed in a slide-out state, according to an embodiment of the present disclosure.
Figure 11:
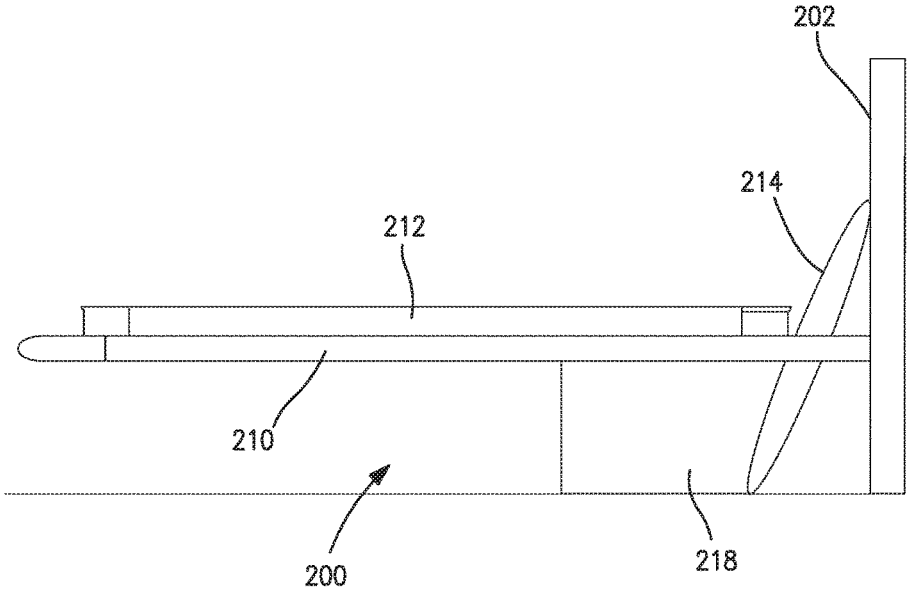
FIG. 11 shows a right side view of a bed in a slide-in state, according to an embodiment of the present disclosure.
Figure 12:
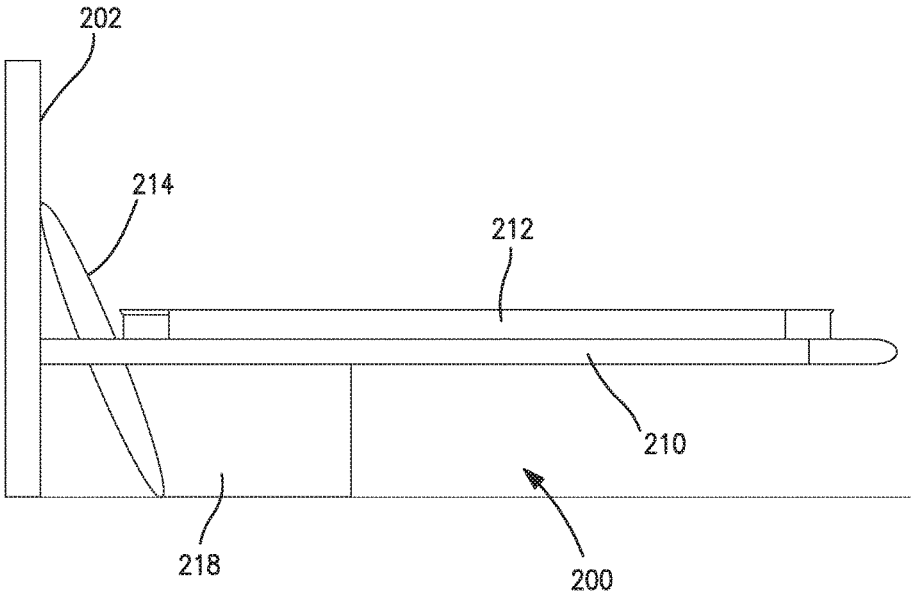
FIG. 12 shows a left side view of a bed in a slide-in state, according to an embodiment of the present disclosure.
Figure 13:
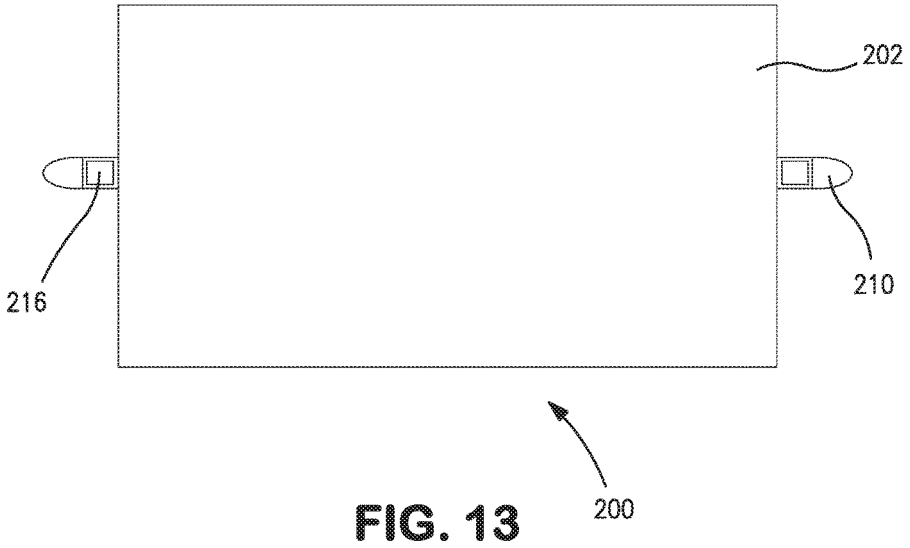
FIG. 13 shows a back side view of a bed in a slide-in state, according to an embodiment of the present disclosure.

FIG. 9 shows a perspective view of a pair of tables and a bed secured to a wall, with the bed being between the tables, according to an embodiment of the present disclosure. FIG. 10A shows a perspective view of a bed in a slide-in state, according to an embodiment of the present disclosure. FIG. 10B shows a perspective view of a bed in a slide-out state, according to an embodiment of the present disclosure. FIG. 11 shows a right side view of bed in a slide-in state, according to an embodiment of the present disclosure. FIG. 12 shows a left side view of bed in a slide-in state, according to an embodiment of the present disclosure. FIG. 13 shows a back side view of bed in a slide-in state, according to an embodiment of the present disclosure. FIG. 13 shows a bottom side view of bed in a slide-in state, according to an embodiment of the present disclosure. Some elements of this figure are described above. Thus, same reference characters identify identical and/or like components described above and any repetitive detailed description thereof will hereinafter be omitted or simplified in order to avoid complication.

An area 200 can be stationary, mobile, volumetrically fixed, or volumetrically adjustable, such as manually or automatically, whether statically or dynamically. For example, the area 200 can comprise or be within a vehicle, a tent, a cubicle, or a room in a building. The area 200 can be used for any purpose. For example, the building can be a detached single-unit housing, a semi-detached dwelling, an attached single-unit housing, an attached multi-unit housing, a moveable dwelling, a warehouse, an hotel, an office building, an apartment building, a shopping mall, a showroom, a convention center, a store, a gym, a garage, or any other type of defined area, whether indoors or outdoors, whether aboveground or underground. The vehicle can be land-based, such as a motorhome, a truck, or a van, marine-based, such as a ship, a boat, a yacht, or a submarine, or aerial-based, such as an airplane, a helicopter, a hot air balloon, a rocket, a space station, or any other type of vehicle, whether manned or unmanned.

The area 200 is defined via a sidewall 202, which can include a wallpaper or a hanging rug, and a floor 204, which can be carpeted. The sidewall 202 and the floor 204 are in a perpendicular relationship with each other. Alternatively, the sidewall 202 and the floor 204 are in a non-perpendicular relationship with each other, whether obtusely or acutely angled. The sidewall 202 and the floor 204 can be of any suitable type. For example, the sidewall 202 or the floor 204 can contain wood, plastic, glass, metal, rubber, or any other material. The sidewall 202 or the floor 204 can be solid, perforated, slotted, meshed, latticed, or gridded.

A plurality of side tables 206, 208 is coupled to the sidewall 202 above the floor 204. Such coupling is cantilevered. Alternatively, a single side table 206, 208 can be used. Also alternatively, at least one of the side tables 206, 208 can be one-piece with the sidewall 202. At least one of the side tables 206 can contain a drawer, which deploys via pulling away from the sidewall 202 and retracts via pushing toward the sidewall 202. The drawer can be elastically deployable or retractable, such as via a spring or a foam.

A bed 207 is positioned between the side tables 206, 208 non-immediately. Alternatively, at least one of the side tables 206, 208 is positioned immediate to the bed 207.

The bed 207 includes a plurality of rails 216 extending from the sidewall 202 in a cantilevered manner, whether perpendicular or non-perpendicular to the sidewall 202, such acutely or obtusely angled. Alternatively, the bed 207 includes a single rail 216 extending from the sidewall 202 in a cantilevered manner, whether perpendicular or non-perpendicular to the sidewall 202, such acutely or obtusely angled. At least one of the rails 216 can extend into the sidewall 202, which can be fully through the sidewall 202. At least one of the rails 216 can be coupled to the sidewall 202 indirectly, such as via an adapter or an interconnector, or directly. At least one of the rails 216 extends rectilinearly, but can extend in other manners, such as sinusoidal, arcuate, pulse-shaped, zigzag, or any other manner.

For example, as shown in FIGS. 9-13, the bed 207 includes a bracket 220 coupled to the sidewall 202 via any manner of coupling, such as fastening, mating, interlocking, adhering, clamping, bracketing, tying, or any other suitable manner. Alternatively, the bracket 220 is one-piece with the sidewall 202. The bracket 220 contains at least one of metal, wood, plastic, rubber, glass, stone, or another suitable material. The bracket 220 is one-piece or an assembly via any manner of coupling, such as fastening, mating, interlocking, adhering, clamping, bracketing, tying, or any other suitable manner. Accordingly, at least one of the rails 216 is coupled to the bracket 220, such as via any manner of coupling, such as fastening, mating, interlocking, adhering, clamping, bracketing, tying, or any other suitable manner. However, note that at least one of the rails 216 can couple to the sidewall 202 without the bracket 220, whether via another device, using technologies disclosed herein, or directly, such as via any manner of coupling, such as fastening, mating, interlocking, adhering, clamping, bracketing, tying, or any other suitable manner. Alternatively, at least one of the rails 216 is one-piece with the bracket 220. Also alternatively, at least one of the rails 216 is one-piece with the sidewall 202 such that the at least one of the rails 216 extends from the sidewall 202 in a cantilevered manner, whether perpendicular or non-perpendicular to the sidewall 202, such acutely or obtusely angled.

The rails 216 can be identical to or different from each other in any aspect or characteristic, such as size, shape, cross-section, volume, weight, density, material, structure, function, sidewall securing method, angling, or any other aspect or characteristic. At least one of the rails 216 contains at least one of metal, wood, plastic, rubber, glass, stone, or another suitable material. At least one of the rails 216 is solid or hollow internally. In some embodiments, a bridge can span between the rails 216, at any portion of the rails 216. For example, the bridge can span between distal end portions of the rails 216 such that a U-shape is defined thereby. Alternatively, the bridge can span between the rails 216 to define an H-shape thereby. Alternatively, the bridge can span between the rails 216 to define an Z-shape thereby. Note that the bridge can be one-piece with or an assembly with at least one of the rails 216 via any manner of coupling, such as fastening, mating, interlocking, adhering, clamping, bracketing, tying, or any other suitable manner. The bridge itself is one-piece or an assembly via any manner of coupling, such as fastening, mating, interlocking, adhering, clamping, bracketing, tying, or any other suitable manner. The bridge can contain at least one of metal, wood, plastic, rubber, glass, stone, or another suitable material.

The bed 207 further includes a frame 210, which contains at least one of metal, wood, plastic, rubber, glass, stone, or another suitable material. The frame 210 is one-piece or an assembly via any manner of coupling, such as fastening, mating, interlocking, adhering, clamping, bracketing, tying, or any other suitable manner. Alternatively, the frame 210 can comprise a plurality of distinct unconnected pieces, such as I-shaped. The frame 210 is U-shaped, but other shapes are possible, such as H-shaped or E-shaped. In some embodiments, the frame 210 can extend into the sidewall 202. The frame 210 extends rectilinearly, but can extend in other manners, such as sinusoidal, arcuate, pulse-shaped, zigzag, or any other manner.

The frame 210 is coupled to the rails 216. Such coupling can be via any manner, such as fastening, mating, interlocking, adhering, clamping, bracketing, tying, suspension, levitation, or any other suitable manner. Alternatively, the frame 210 is one-piece with at least one of the rails 216.

The frame 210 can be fixed to the rails 216 or be stationary with respect to the rails 216. Alternatively, the frame 210 can be movable with respect to the rails 216. For example, when the frame 210 is movable with respect to the rails 216, as shown in FIG. 10B, such movement can be enabled via various techniques. Some of such techniques can be based on a wheel, a roller, a track, a sphere, or any other methodology to allow for movement along a plane, whether horizontal, vertical, diagonal, or any combination thereof. Such movement can be manual, such as hand-driven, or automatic, such as motor-driven, for instance, an electric motor. For example, the frame 210 or at least one of the rails 216 can comprise at least one of a roller, a sphere, or a wheel engaging the frame 210 or the at least one of the rails 216 respectively. Alternatively, such movement can also be enabled via sliding or suspension, such as levitation, which can be magnetic. As above, such movement can be manual, such as hand-driven, or automatic, such as motor-driven, for instance, an electric motor. For example, the frame 210 can slide against or on at least one of the rails 216 respectively and such sliding action can be smooth. Likewise, the frame 210 can be magnetically levitated from at least one of the rails 216.

The frame 210 or at least one of the rails 216 can comprise a stopping mechanism, a travel limiter, or a brake to limit movement of the frame 210 with respect to the rails 216. For example, at least one of the rails 216 can comprise a first vertical member and the frame 210 comprises a second vertical member, which engage each other to limit movement of the frame 210 with respect to the rails 216. Also, for example, the frame 210 can comprise a tapered inner space and at least one of the rails 216 can comprise a vertical member to engage the frame 210 internally to limit movement of the frame 210 with respect to the rails 216. Also, for example, the frame 210 can comprise a braking mechanism configured to brake against at least one of the rails 216 to limit movement of the frame 210 with respect to the rails 216. Alternatively, the frame 210 lacks the stopping mechanism, the travel limiter, or the brake. Also alternatively, the frame 210 can decouple from at least one of the rails 216.

The bed 207 also includes a platform 212, which can be sufficiently rigid to support a mattress, as described herein, or a user. For example, the platform 212 can function as the platform 176. For example, the mattress can include a rigid portion, such as disclosed herein, to support a user thereon. For example, the platform 212 can be a mattress. The platform 212 can include an internal or underside frame, as disclosed herein, such as dual E-shaped or herringbone shaped. The platform 212 rests on or is coupled to the frame 210. For example, the frame 210 can comprise a lip or a ledge, such as L-shaped, to support the platform 212. Such coupling can be via any manner of coupling, such as fastening, mating, interlocking, adhering, clamping, bracketing, tying, or any other suitable manner. For example, the frame 210 can be U-shaped longitudinally and thereby contain the platform 212. Alternatively, the platform 212 and the frame 210 are one-piece. The platform 212 can contain at least one of metal, wood, plastic, rubber, glass, stone, or another suitable material. The platform 212 extends rectilinearly, but can extend in other manners, such as sinusoidal, arcuate, pulse-shaped, zigzag, or any other manner. The platform 212 is shaped in a rectangular manner. However, the platform 212 can also be shaped in a non-rectangular manner, such as a square, a triangle, a star, a pentagon, a trapezoid, or any other polygonal shape. In some embodiments, the platform 212 is coupled to the rails 216 along with the frame 210, as disclosed herein.

The frame 210 can be fixed to the platform 212 or be stationary with respect to the platform 212. Alternatively, the frame 210 can be movable with respect to the platform 212 or vice versa. For example, when the frame 210 is movable with respect to the platform 212, as shown in FIG. 10B, such movement can be enabled via various techniques. Some of such techniques can be based on a wheel, a roller, a track, a sphere, or any other methodology to allow for movement along a plane, whether horizontal, vertical, diagonal, or any combination thereof. Such movement can be manual, such as hand-driven, or automatic, such as motor-driven, for instance, an electric motor. For example, the frame 210 or the platform 212 can comprise at least one of a roller, a sphere, or a wheel engaging the frame 210 or the platform 212 respectively. Alternatively, such movement can also be enabled via sliding or suspension, such as levitation, which can be magnetic. As above, such movement can be manual, such as hand-driven, or automatic, such as motor-driven, for instance, an electric motor. For example, the platform 212 can slide against or on the frame 210 and such sliding action can be smooth. Likewise, the platform 212 can be magnetically levitated from the frame 210.

The frame 210 or the platform 212 can comprise a stopping mechanism, a travel limiter, or a brake to limit movement of the frame 210 with respect to the platform 212 or vice versa. For example, the platform 212 can comprise a first vertical member and the frame 210 comprises a second vertical member, which engage each other to limit movement of the platform 212 with respect to the frame 210. Also, for example, the platform 212 can comprise a braking mechanism configured to brake against frame 210 to limit movement of the platform 212 with respect to the frame 210. Alternatively, the frame 210 or the platform 212 lacks the stopping mechanism, the travel limiter, or the brake. Also alternatively, the platform 212 can decouple from frame 210.

The bed 207 further includes a headboard 214. The headboard 214 can be one-piece or assembled, such as via fastening, mating, interlocking, adhering, clamping, bracketing, tying, or any other suitable manner. The headboard 214 contains at least one of metal, wood, plastic, rubber, glass, stone, or another suitable material. The headboard 214 can be one-piece with or assembled with at least one of the sidewall 202, the floor 204, at least one of the rails 216, the frame 210, or the platform 212. The headboard 214 extends rectilinearly, but can extend in other manners, such as sinusoidal, arcuate, pulse-shaped, zigzag, or any other manner. The headboard 214 is shaped in a rectangular manner. However, the headboard 214 can also be shaped in a non-rectangular manner, such as a square, a triangle, a star, a pentagon, a trapezoid, or any other polygonal shape.

The headboard 214 is positioned between the rails 216. Such positioning can be immediate to at least one of the rails 216, such as via the headboard 214 spanning between the rails 216. Alternatively, the headboard 214 is positioned between the rails 216 non-immediately to at least one of the rails 216. The headboard 214 can also be positioned between the frame 210, such as selectively. Such positioning can be immediate, such as the headboard 214 spanning between the frame 210, or non-immediate. The platform 212 can extend from the headboard 214 when the platform 212 is positioned immediately adjacent to the headboard 214, whether such positioning is attachable/detachable or whether the platform 212 and the headboard 214 are one piece.

The headboard 214 is non-perpendicular to at least one of the rails 216, whether obtusely or acutely. Alternatively, the headboard 214 is perpendicular to at least one of the rails 216. An upper portion of the headboard 214 contacts the sidewall 202, which can include coupling to the sidewall 202, such as via fastening, mating, interlocking, adhering, clamping, bracketing, tying, or any other suitable manner. In some embodiments, the upper portion of the headboard 214 avoids contacting the sidewall 202. A lower portion of the headboard 214 contacts the floor 204, which can include coupling to the floor 204, such as fastening, mating, interlocking, adhering, clamping, bracketing, tying, or any other suitable manner. In some embodiments, the lower portion of the headboard 214 avoids contacting the floor 204. Accordingly, the headboard 214 spans between the sidewall 202 and the floor 204. In some embodiments, at least one of the upper portion of the headboard 214 or the lower portion of the headboard 214 extends into at least one of the sidewall 202 or the floor 204 respectively, which can include extending fully through at least one of the sidewall 202 or the floor 204 respectively.

The bed 207 also includes a spine 218 extending from the headboard 214 away from the sidewall 202 such that the spine 218 can support the platform 212 when the platform 212 is positioned above the spine 207. The spine 218 extends rectilinearly, but can extend in other manners, such as sinusoidal, arcuate, pulse-shaped, zigzag, or any other manner. The spine 218 is shaped in a rectangular manner. However, the spine 218 can also be shaped in a non-rectangular manner, such as a square, a triangle, a star, a pentagon, a trapezoid, or any other polygonal shape.

The spine 218 can be one-piece or assembled, such as via fastening, mating, interlocking, adhering, clamping, bracketing, tying, or any other suitable manner. The spine 218 contains at least one of metal, wood, plastic, rubber, glass, stone, or another suitable material. The spine 218 can be one-piece with or assembled with at least one of the sidewall 202, the floor 204, the headboard 214, or the platform 212, such as via fastening, mating, interlocking, adhering, clamping, bracketing, tying, or any other suitable manner. The spine 218 extends perpendicular to the floor 204. Alternatively, the spine 218 extends non-perpendicular to the floor 204, whether obtusely or acutely angled. The spine 218 can be configured to facilitate movement of the platform 212, away from the sidewall 202, against or on the spine 218, such as via including a rail, a track, a wheel, a roller, a magnet, a mater, or other structures, as disclosed herein.

In some embodiments, any structure disclosed herein can comprise at least one of an electronic circuit, a computer, or a sensor.

In the present disclosure, the corresponding structures, materials, acts, and equivalents of all means or step plus function elements in the claims below are intended to include any structure, material, or act for performing the function in combination with other claimed elements as specifically claimed. Note that the scope of the present disclosure is defined by the claims, which includes known equivalents and unforeseeable equivalents at the time of filing of the present disclosure. This disclosure has been presented for purposes of illustration and description, but is not intended to be fully exhaustive and/or limited to the disclosure in the form disclosed. Many modifications and variations in techniques and structures will be apparent to those of ordinary skill in the art without departing from the scope and spirit of the disclosure as set forth in the claims that follow. Accordingly, such modifications and variations are contemplated as being a part of the present disclosure.

The invention claimed is:

1. A device comprising:

a bed frame comprising a platform frame and a headboard frame, wherein the platform frame is T-shaped as defined via a leg portion and a platform portion, wherein the platform portion comprises a head portion and a foot portion, wherein the leg portion extends toward the foot portion, wherein the headboard frame includes a first end portion and a second end portion, wherein the headboard frame engages the head portion such that the headboard frame is non-perpendicularly oriented to the head portion when the headboard frame spans between a wall and a floor such that the first end portion contacts the wall and the second end portion contacts the floor, the head portion extends away from the wall, and the headboard frame is secured to the wall at a location distal to the floor, wherein the leg portion engages the floor and thereby supports the platform portion.

2. The device of claim 1, wherein the platform portion is a single integral piece, wherein the platform portion comprises a spine portion extending longitudinally over the leg portion, wherein the spine portion extends between the head portion and the foot portion.

3. The device of claim 2, wherein the headboard frame defines a U-shaped channel through which the spine portion extends.

4. The device of claim 3, further comprising:

a bolt extending across the U-shaped channel and through the spine portion.

5. The device of claim 1, wherein the leg portion comprises a reinforcement column configured to extend between the floor and the platform portion.

6. The device of claim 1, wherein the platform portion is an assembly of a pair of rectangular portions, wherein each of the rectangular portions comprises a longitudinal portion, wherein the longitudinal portions are positioned immediately adjacent to each other to define a spine portion, wherein the platform portion comprises the spine portion.

7. The device of claim 6, wherein the longitudinal portions are fastened to each other.

8. The device of claim 1, wherein the platform portion supports a mattress platform defined via a plurality of slats positioned immediately adjacent to each other.

9. The device of claim 8, wherein the slats are aligned via a dowel.

10. The device of claim 1, wherein the headboard frame is inclined between about 110 degrees to about 160 degrees relative to the platform frame.

11. The device of claim 1, wherein the headboard frame is secured to the wall at the location distal to the floor via at least one of fastening, mating, interlocking, adhering, clamping, bracketing, or tying.

12. The device of claim 1, wherein the headboard frame includes a pair of bars which extend lateral to the platform portion, wherein at least one of the bars is configured as an angled cap.

13. A device comprising: a bed frame comprising a platform frame and a headboard frame, wherein the platform frame is T-shaped as defined via a leg portion and a platform portion such that the leg portion is substantially perpendicular to the platform portion and such that the leg portion is substantially laterally centered relative to the platform portion, wherein the headboard frame includes a first end portion and a second end portion, wherein the headboard frame is non-perpendicularly oriented to the platform portion when the headboard frame spans between a wall and a floor such that the first end portion contacts the wall and the second end portion contacts the floor, the platform portion extends away from the wall, and the headboard frame is secured to the wall at a location distal to the floor, wherein the leg portion engages the floor and thereby supports the platform portion.

14. The device of claim 13, wherein the platform portion comprises a spine portion, wherein the headboard frame is coupled to the spine portion.

15. The device of claim 14, wherein the platform portion is an assembly of a pair of rectangular portions, wherein each of the rectangular portions comprises a longitudinal portion, wherein the spine portion is defined via the longitudinal portions being positioned immediately adjacent to each other.

16. The device of claim 13, wherein the leg portion comprises a reinforcement column configured to extend between the floor and the platform portion.

17. The device of claim 13, wherein the platform portion supports a mattress platform defined via a plurality of slats positioned immediately adjacent to each other.

18. The device of claim 13, wherein the headboard frame is inclined between about 110 degrees to about 160 degrees relative to the platform frame.

19. The device of claim 13, wherein the headboard frame is secured to the wall at the location distal to the floor via at least one of fastening, mating, interlocking, adhering, clamping, bracketing, or tying.

20. The device of claim 13, wherein the headboard frame includes a pair of bars which extend lateral to the platform portion, wherein at least one of the bars is configured as an angled cap.

* * * * *